US012290712B2

(12) United States Patent
D'Ambrosio-Correll et al.

(10) Patent No.: US 12,290,712 B2
(45) Date of Patent: May 6, 2025

(54) SMART FLEXIBLE EXERCISE WEIGHT

(71) Applicant: Curiouser Products Inc., New York, NY (US)

(72) Inventors: Kristie D'Ambrosio-Correll, Sands Point, NY (US); Eric D'Ambrosio-Correll, Sands Point, NY (US); Brynn Putnam, New York, NY (US)

(73) Assignee: Curiouser Products Inc., New York, NY (US)

( * ) Notice: Subject to any disclaimer, the term of this patent is extended or adjusted under 35 U.S.C. 154(b) by 238 days.

(21) Appl. No.: 17/975,716

(22) Filed: Oct. 28, 2022

(65) Prior Publication Data

US 2023/0135228 A1 May 4, 2023

Related U.S. Application Data

(60) Provisional application No. 63/273,737, filed on Oct. 29, 2021.

(51) Int. Cl.
*A63B 21/065* (2006.01)
*A63B 21/06* (2006.01)
*A63B 71/06* (2006.01)

(52) U.S. Cl.
CPC ..... *A63B 21/065* (2013.01); *A63B 21/0603* (2013.01); *A63B 71/0619* (2013.01); *A63B 2220/833* (2013.01); *A63B 2225/50* (2013.01)

(58) Field of Classification Search
CPC ..... A63B 21/065; A63B 21/0603; A63B 71/0619; A63B 2220/833; A63B 2225/50; A63B 2024/0068; A63B 2071/0647; A63B 2071/0694; A63B 2220/806; A63B 2225/12; A63B 2225/20; A63B 2225/74; A63B 21/0607
See application file for complete search history.

(56) References Cited

U.S. PATENT DOCUMENTS 3,406,968 A * 10/1968 Mason ..... A43B 19/005 D21/683
4,239,211 A * 12/1980 Wilkerson ..... B63C 11/30 273/DIG. 30
4,384,714 A * 5/1983 Kimura ..... A63B 21/065 482/79
D270,652 S * 9/1983 Winston ..... D21/683
(Continued)

OTHER PUBLICATIONS

Invitation to Pay Additional Search Fees mailed Feb. 6, 2023 for International Application No. PCT/US2022/078865, 14 pages.
(Continued)

*Primary Examiner* — Sundhara M Ganesan
(74) *Attorney, Agent, or Firm* — COOLEY LLP

(57) ABSTRACT

A flexible weight that can be secured to a wearer during performance of an exercise. The weight is segmented, with each segment from a set of segments including an associated bolster-shaped unit having a plurality of pellets suspended in a cured gel, the pellets/gel being positioned within a casing. The set of segments is contained within an outer pouch that is substantially conformal with the set of segments, and the segments from the set of segments are arranged in a linear array. The weight also includes an endcap with a colored light indicator and electronics for communicating with a smart mirror.

30 Claims, 25 Drawing Sheets

(56) References Cited

U.S. PATENT DOCUMENTS

D271,051 S * 10/1983 McCoy ..... D21/679
4,951,940 A * 8/1990 Vitello ..... B29C 43/003 224/148.1
4,997,183 A * 3/1991 Winston ..... A63B 21/065 482/74
5,120,288 A 6/1992 Sinaki
D339,838 S * 9/1993 Winston ..... D21/683
5,868,652 A * 2/1999 Spletzer ..... A63B 21/065 2/22
6,005,041 A * 12/1999 Cook ..... A63B 21/06 524/439
6,209,135 B1 * 4/2001 Irvin ..... A63B 21/065 2/102
D582,994 S 12/2008 Ulichney et al.
D685,440 S * 7/2013 Tuttle ..... D21/683
10,449,407 B1 * 10/2019 Abbas ..... B65B 1/04
D888,167 S * 6/2020 Kislevitz ..... D21/683
10,758,780 B2 9/2020 Putnam
D934,099 S * 10/2021 Qin ..... D21/683
11,167,172 B1 11/2021 Putnam et al.
D944,904 S * 3/2022 He ..... D21/683
D952,773 S * 5/2022 Chen ..... D21/683
D954,689 S 6/2022 Forster et al.
D967,912 S * 10/2022 Chen ..... D21/683
D980,353 S * 3/2023 Dan ..... D21/683
D1,001,214 S * 10/2023 D'Ambrosio-Correll ... D21/680
2003/0177984 A1 * 9/2003 Newman ..... A01K 15/027 119/850
2004/0043875 A1 * 3/2004 Lederfeind ..... A63B 21/4009 482/105
2007/0066455 A1 * 3/2007 Leavitt ..... A63B 21/065 482/93
2007/0099774 A1 * 5/2007 Bruback ..... B63C 11/30 482/105
2010/0064413 A1 * 3/2010 Koelle ..... A63B 21/4013 2/113
2011/0009713 A1 * 1/2011 Feinberg ..... A63B 21/065 482/8
2011/0287904 A1 * 11/2011 Morris ..... A63B 21/0602 482/93
2012/0144554 A1 * 6/2012 Thellmann ..... A63B 71/0622 2/161.1
2013/0085040 A1 * 4/2013 Bowers ..... A63B 21/0557 482/8
2013/0130848 A1 * 5/2013 Homsi ..... A63B 43/06 473/570
2013/0237391 A1 * 9/2013 Haley ..... A63B 21/00065 482/105
2016/0129296 A1 * 5/2016 Haley ..... A63B 21/065 482/105
2017/0182350 A1 * 6/2017 Haley ..... A63B 21/065
2017/0225032 A1 * 8/2017 Jones ..... A41D 1/002
2017/0266477 A1 * 9/2017 Cordero ..... A63B 71/0686
2017/0304670 A1 * 10/2017 Herron ..... A63B 21/065
2017/0361146 A1 * 12/2017 Malcolm ..... A63B 69/0028
2017/0361159 A1 * 12/2017 Malcolm ..... G06F 1/1626
2018/0235292 A1 * 8/2018 Akinyemi ..... A61B 5/6806
2020/0121972 A1 * 4/2020 Auguste ..... A63B 21/4025
2020/0171336 A1 * 6/2020 Brown, Jr. ..... A63B 23/03508
2020/0298054 A1 * 9/2020 Manion ..... A63B 21/012
2021/0008413 A1 * 1/2021 Asikainen ..... G06F 3/0304
2021/0106282 A1 * 4/2021 Malcolm ..... A63B 21/028
2022/0087898 A1 * 3/2022 Reynolds ..... A63B 21/00196
2023/0009796 A1 * 1/2023 Olander ..... A63B 21/4007
2023/0129601 A1 * 4/2023 Kassa ..... A63B 21/075 482/108
2023/0135228 A1 * 5/2023 D'Ambrosio-Correll ..... A63B 21/0607 482/105

OTHER PUBLICATIONS

U.S. Appl. No. 29/813,651, filed Oct. 29, 2021.
Lusper, announced 2022 [online], [site visited Apr. 25, 2023]. Available on the Internet at URL:https://www.amazon.com/Lusper-Ankle-Weights-Women-Adjustable/dp/BOB9N7WYWK/ref (Year: 2022), 8 pages.
Bala, announced 2022 [online], [site visited Apr. 25, 2023]. Available on the Internet at URL:https://www.amazon.com/Bala-Bangles-Adjustable-Wearable-Monochromatic/dp/B09SP2TB33/ref (Year: 2022), 6 pages.

* cited by examiner

SMART FLEXIBLE EXERCISE WEIGHT

CROSS-REFERENCE TO RELATED PATENT APPLICATIONS

This application claims priority to and the benefit of U.S. Provisional Patent Application No. 63/273,737, filed on Oct. 29, 2021 and titled "Smart Flexible Exercise Weight," and this application is related to U.S. Pat. No. 10,758,780, issued Sep. 1, 2020 and titled "Reflective Video Display Apparatus for Interactive Training and Demonstration and Methods of Using Same," and to U.S. patent application Ser. No. 17/243,705, filed Apr. 29, 2021 and titled "Reflective Video Display Apparatus for Interactive Training and Demonstration and Methods of Using Same," and to U.S. patent application Ser. No. 17/464,960, filed Sep. 2, 2021 and titled "Video Streaming with Multiplexed Communications and Display via Smart Mirrors," and to U.S. Provisional Patent Application No. 63/273,775, filed Oct. 29, 2021 and titled "Smart Dumbbell," and to U.S. Design patent application Ser. No. 29/813,651, filed Oct. 29, 2021 and titled "Exercise Weight," the entire contents of each of which are incorporated herein by reference in their entireties.

FIELD

The present disclosure relates to exercise equipment, and more specifically, to "smart" free weights that include electronics and/or software configured to communicate with smart mirrors.

BACKGROUND

Exercise is an important part of maintaining an individual's health and wellbeing. To derive the most benefit from strength training exercises in particular, it is important for a user to use proper form and technique. Many people, however, are increasingly exercising at home, without the assistance of a personal trainer to observe or correct them, and thus may develop "bad habits" with respect to exercise form and technique, even if using "smart" home exercise equipment such as smart mirrors.

SUMMARY

In some embodiments, an apparatus includes an elongate flexible housing and a plurality of elongate weights positioned within the elongate flexible housing. Each elongate weight from the plurality of elongate weights includes a plurality of pellets embedded within a cured gel. The elongate flexible housing is configured to be positioned about a portion of a body of a user during use.

In some embodiments, an apparatus includes an elongate flexible housing, an electronics assembly, a plurality of elongate weights, and a first fastener portion affixed to the first portion of the elongate flexible housing. The electronics assembly is positioned within a first portion of the elongate flexible housing, and includes at least one light-emitting diode (LED). The plurality of elongate weights is positioned within a second portion of the elongate flexible housing, and the second portion of the elongate flexible housing is different from and linearly spaced from the first portion of the elongate flexible housing. Each elongate weight from the plurality of elongate flexible weights includes a plurality of pellets. The first fastener portion is configured to mechanically couple with a second fastener portion of the second portion of the elongate flexible housing.

In some embodiments, a method of producing an exercise apparatus includes producing a plurality of elongate weights and assembling the exercise apparatus by placing each elongate weight from the plurality of elongate weights into an elongate flexible housing. The producing the plurality of elongate weights includes combining a plurality of pellets with a gel. For example, the pellets and the gel can be combined to produce a mixture, and the mixture can be introduced into a sleeve to produce a filled sleeve. The filled sleeve can then be at least one of constricted or twisted (e.g., in multiple locations), to produce a plurality of terminations along the filled sleeve, and the filled sleeve can be cleaved at each termination from the plurality of terminations, to produce the plurality of elongate weights. As an alternative example, the pellets and the gel can be molded or formed into the plurality of weights (e.g., having a capsule shape).

In some embodiments, a kit includes a first exercise apparatus and a second exercise apparatus. The first exercise apparatus includes a first elongate flexible housing and a first plurality of elongate weights. The first plurality of elongate weights is positioned within the first elongate flexible housing, and each elongate weight from the first plurality of elongate weights includes a first plurality of pellets embedded within a first cured gel. The first elongate flexible housing is configured to be positioned about a portion of a body of a user during use. The second exercise apparatus includes a second elongate flexible housing and a second plurality of elongate weights. The second plurality of elongate weights is positioned within the second elongate flexible housing, and each elongate weight from the second plurality of elongate weights includes a second plurality of pellets embedded within a second cured gel. The second elongate flexible housing is configured to be positioned about a second portion of the body of the user during use.

DETAILED DESCRIPTION

The demand for home fitness products has been increasing for years. And in the midst of widespread public health concerns arising from Covid-19, forcing many to self-quarantine, such demand, in particular for "interactive" home fitness products, has been further enhanced. Known approaches to interactive fitness, however, typically involve a user interacting with a software application running on a smartphone, making it difficult to coordinate movements with the ability to clearly view the instruction rendered via the smartphone screen. Moreover, while exercise equipment such as smart mirrors may provide users with visual guidance and feedback on a larger scale with respect to form and/or technique, users who exercise with free weights such as dumbbells, barbells, or flexible weights (e.g., wrist weights, ankle weights, etc.) may still be unable to discern incorrect form or technique when only viewing themselves from a single direction (e.g., in a reflected image of a smart mirror) or when only viewing video content depicting an instructor. Moreover, known free weights do not include functionality for automatically tracking their usage.

Smart Flexible Exercise Weights

Smart flexible exercise weights of the present disclosure, according to some embodiments, include an elongate flexible housing and a plurality of elongate weights (also referred to herein as capsules or weights) positioned within the elongate flexible housing. Each elongate weight from the plurality of elongate weights includes a plurality of pellets (also referred to herein as shot, beads, balls, or spheres) embedded within a binder such as a cured gel. Each elongate weight from the plurality of elongate weights can have a shape that is at least one of: substantially cylindrical, substantially pill-shaped, substantially bolster-shaped, substantially ovoid-shaped, or substantially egg-shaped. The elongate flexible housing can also include an electronics assembly positioned, for example, within a first portion of the elongate flexible housing mutually exclusive of a second portion of the elongate flexible housing that includes the plurality of elongate weights. The electronics assembly can include at least one light-emitting diode (LED) that serves as an indicator to a user during use, as discussed further below. The elongate flexible housing is configured to be positioned about a portion of a body of a user during use. The portion of the body of the user can include an ankle, a wrist, a thigh, a forearm, an upper arm, or a torso of the user.

Figure 1A:
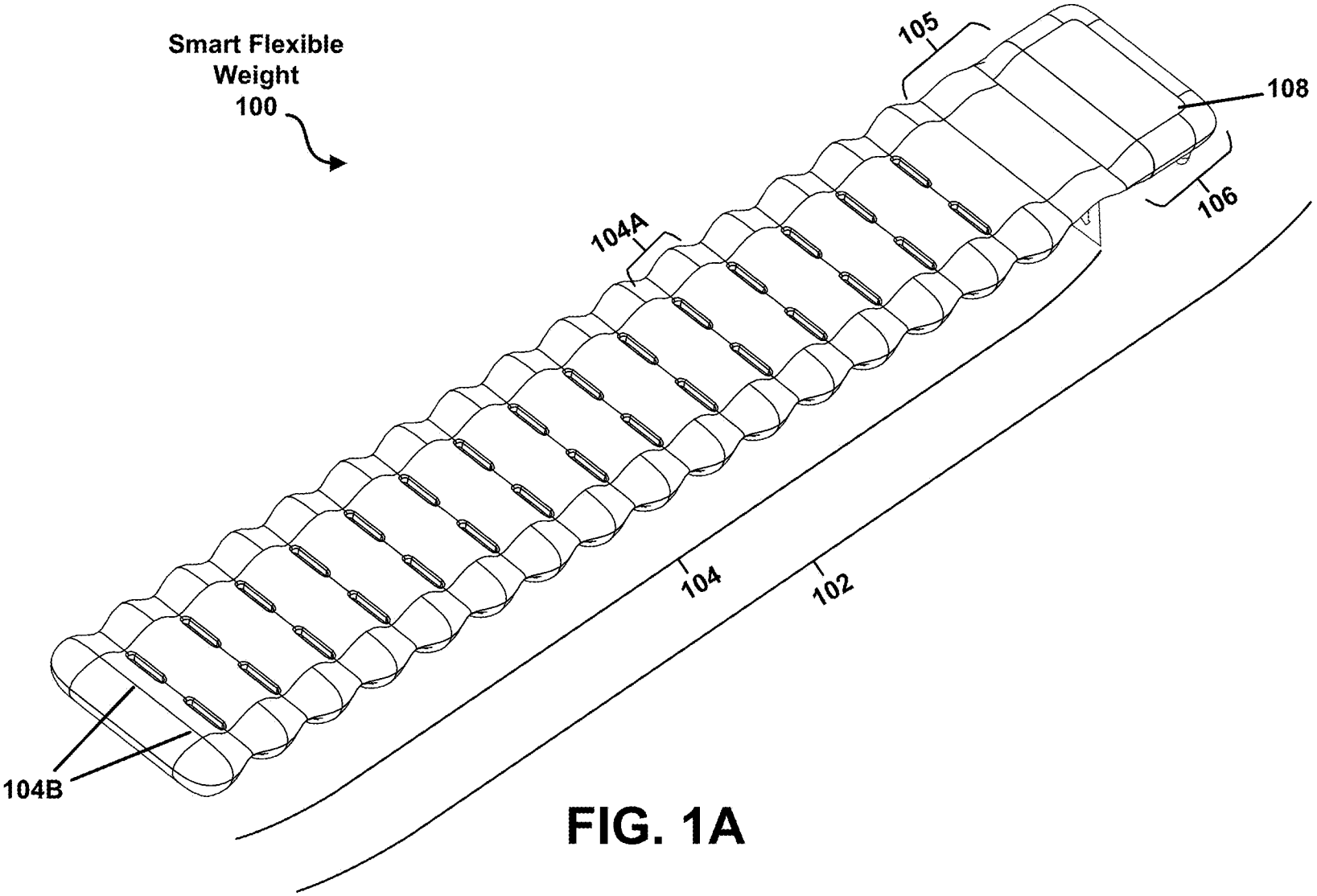
FIG. 1A is a diagram showing a top perspective view of a fully assembled smart flexible exercise weight, in accordance with some embodiments.

FIG. 1A is a diagram showing a top perspective view of a fully assembled smart flexible exercise weight, in accordance with some embodiments. As shown in FIG. 1A, the smart flexible weight 100 includes an elongate flexible housing portion 104, a plurality of elongate weight sections 104A, a transition section 105 that does not include a weight section 104A, and an end cap 106 with a numeral-shaped indicator portion 108. The elongate flexible housing portion 104 includes a plurality of pairs of slots or recesses 104B defined therein, whose function is described below.

Figure 1B:
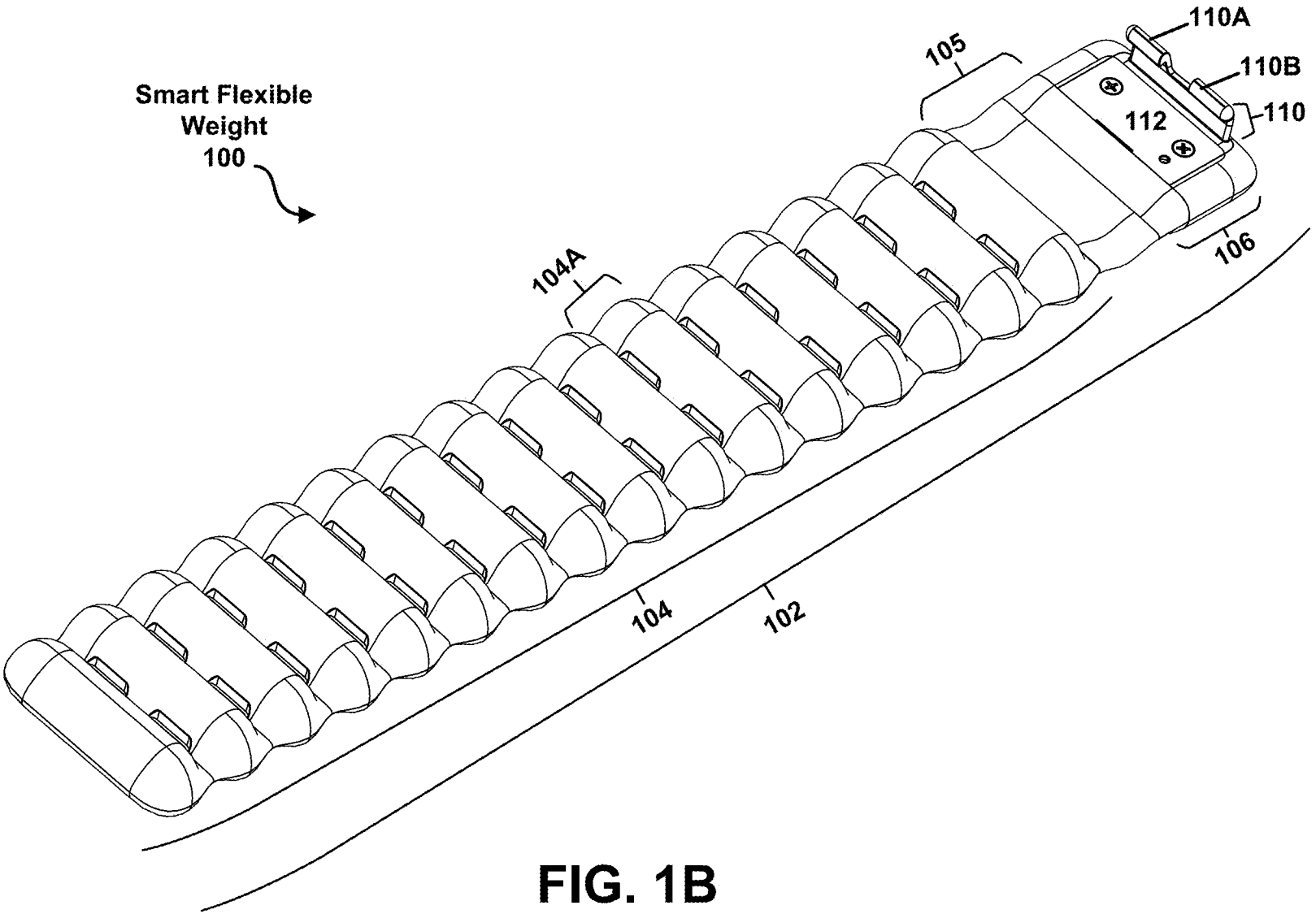
FIG. 1B is a diagram showing a bottom perspective view of the fully assembled smart flexible exercise weight of FIG. 1A.
Figure 1C:
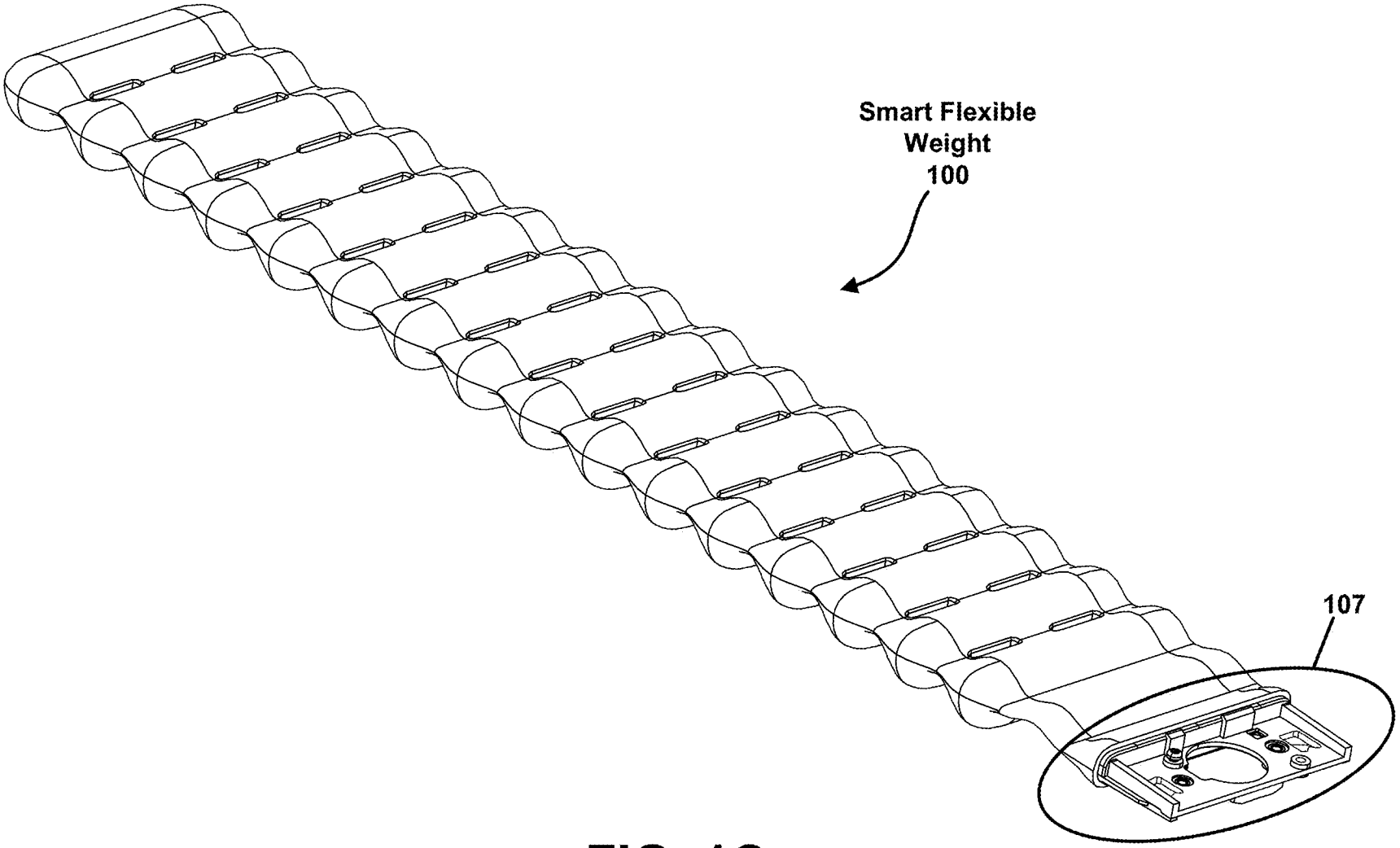
FIG. 1C is a diagram showing a modified view of the fully assembled smart flexible exercise weight of FIG. 1A, without electronics installed.

FIG. 1B is a diagram showing a bottom perspective view of the fully assembled smart flexible exercise weight of FIG. 1A. In FIG. 1B, an electronics access door 112 (affixed by screws in this embodiment, although other means of attachment, such as slidable doors, are also possible in other implementations) and a hook fastener 110, including protrusions 110A and 110B. Each of protrusions 110A and 110B of the hook fastener 110 is configured to be inserted into an associated slot or recess from a desired pair of slots or recesses 104B from the slots or recesses 104B of FIG. 1A. FIG. 1C is a diagram showing a modified view of the fully assembled smart flexible exercise weight of FIG. 1A, without electronics and electronics access door 112 installed. In particular, an electronics carrier assembly 107 (also referred to herein as an electronics adapter) is visible in FIG. 1C.

Figure 1D:
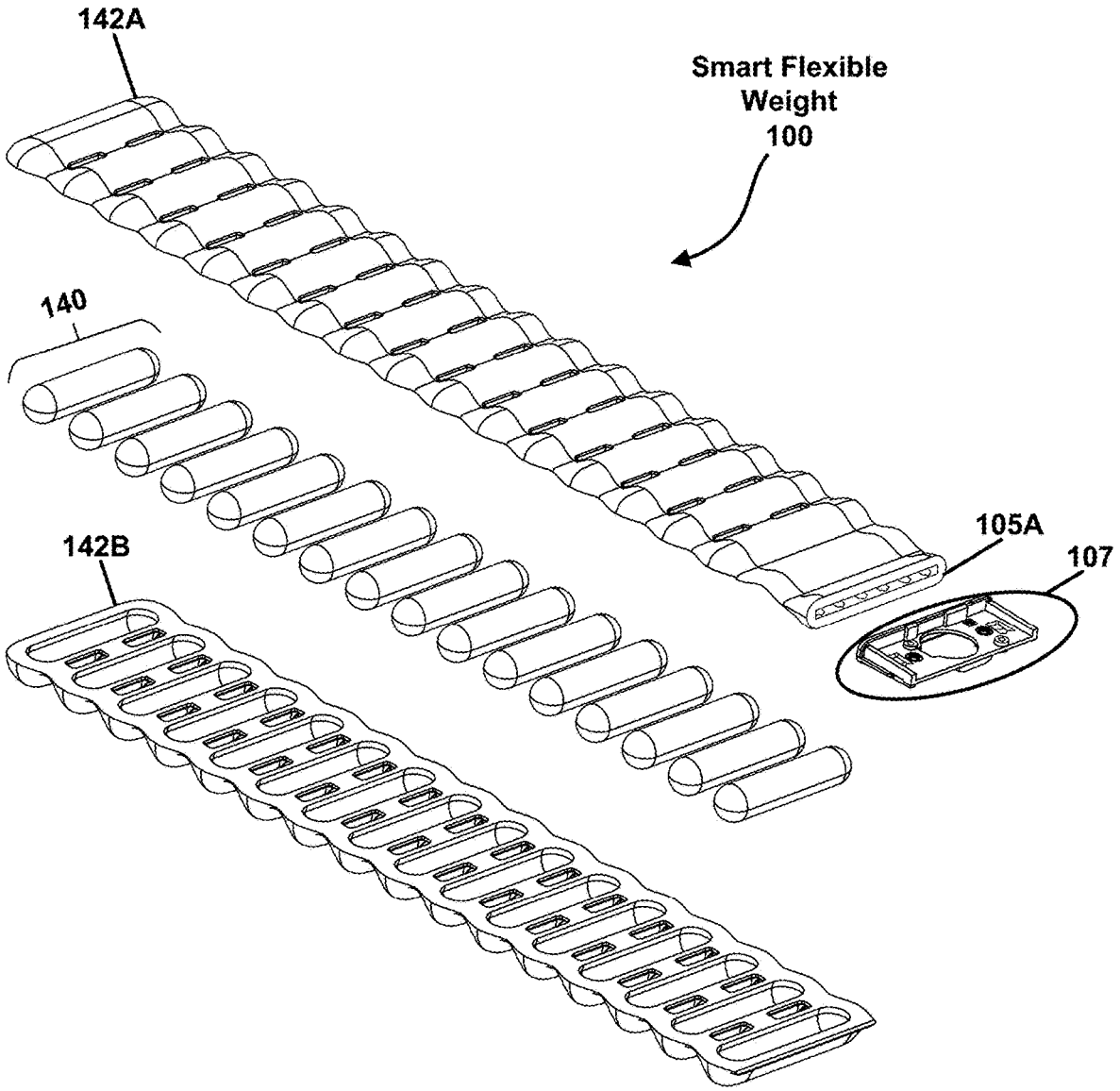
FIG. 1D is a diagram showing an exploded view of the smart flexible exercise weight of FIG. 1A.

FIG. 1D is a diagram showing an exploded view of the smart flexible exercise weight of FIG. 1A. As shown in FIG. 1D, the smart flexible weight 100 includes a lower casing portion 142B, a plurality of elongate weights 140, and an upper casing portion 142A. A connector region 105A of the upper casing portion 142A is configured to mechanically attach to/mate with the electronics carrier assembly 107.

Figure 1E:
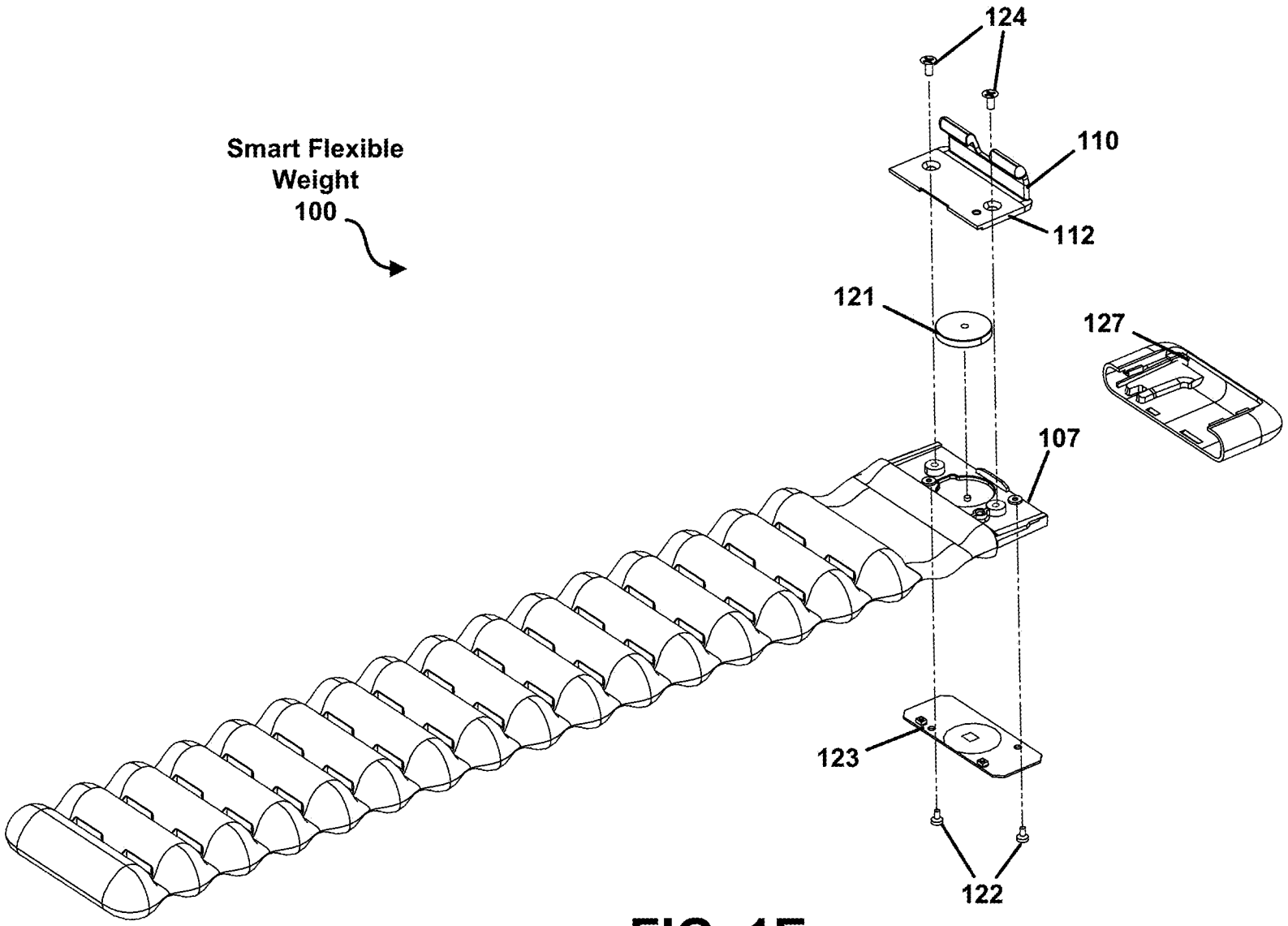
FIG. 1E is a diagram showing an exploded view of the smart flexible exercise weight of FIG. 1A, showing the positioning of electronics relative to over-molded weights.
Figure 2:
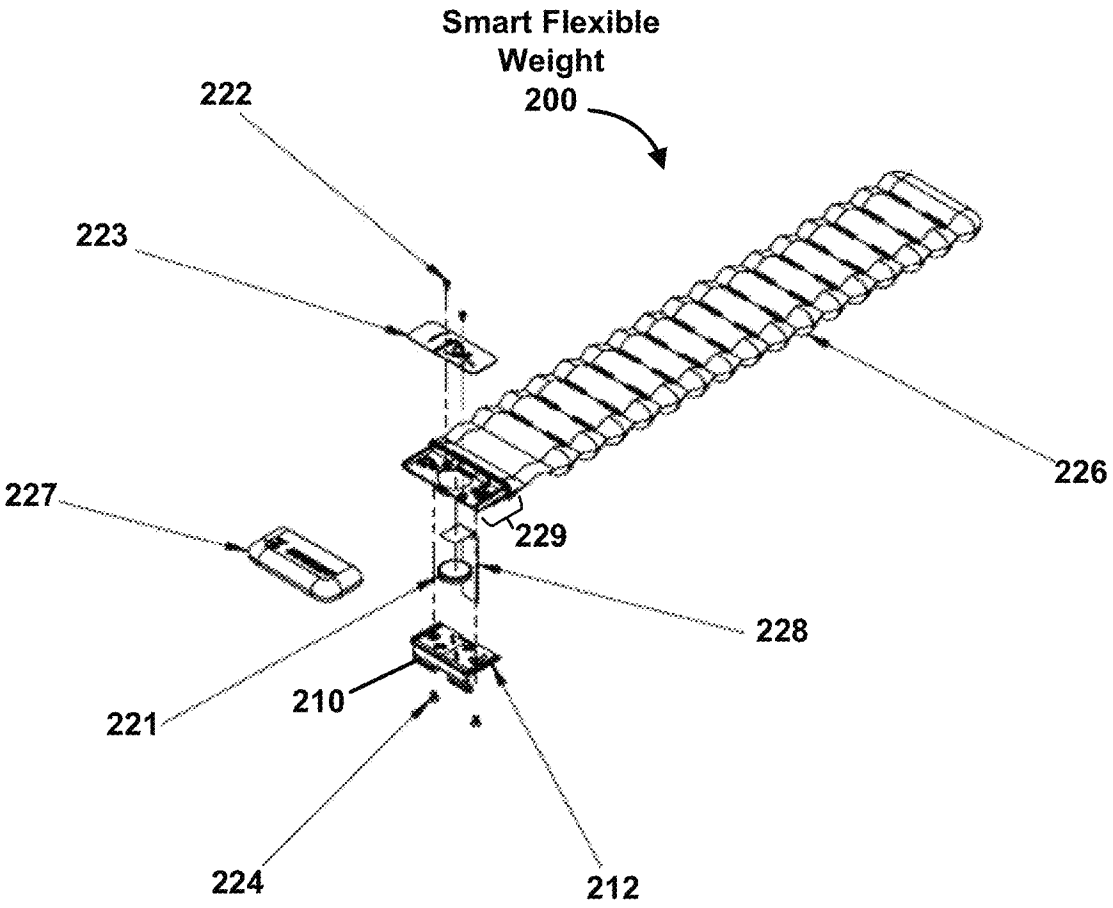
FIG. 2 is a diagram showing an exploded view of a smart flexible exercise weight, in accordance with some embodiments.

FIG. 1E is a diagram showing an exploded view of the smart flexible exercise weight of FIG. 1A, showing the positioning of electronics relative to the over-molded elongate weights (i.e., when the upper casing portion 142A is over-molded over the plurality of elongate weights 140 and the lower casing portion 142B and electronics carrier assembly 107). As shown in FIG. 1E, the endcap portion of the smart flexible weight 100 includes a hook 110 and a battery door 112 (optionally integrally formed with one another, e.g., in plastic) securable by screws 124 to the electronics carrier assembly 107, and the electronics carrier assembly 107 is sized and shaped to accommodate a battery 121. A printed circuit board 123 is also securable to the electronics carrier assembly 107 via screws 122, and an outer shell 127 including a light guide (also referred to herein as a "window" or "numeral-shaped portion") is configured to cover a portion of the electronics and mechanically secure to the electronics carrier assembly 107, along with the hook 110 and battery door 112. FIG. 2 is a diagram showing an exploded view of the smart flexible exercise weight from a different perspective relative to FIG. 1E, and showing similar components, in accordance with some embodiments. Specifically, the smart flexible weight 200 includes an elongate flexible housing portion 226, and an endcap portion, which includes a hook 210 and a battery door 212 (optionally integrally formed with one another, e.g., in plastic) securable by screws 224 to the electronics carrier assembly 207, and the electronics carrier assembly 207 is sized and shaped to accommodate a battery 221. A printed circuit board 223 is also securable to the electronics carrier assembly 207 via screws 222, and an outer shell 227 including a light guide (also referred to herein as a "window" or "numeral-shaped portion") is configured to cover a portion of the electronics and mechanically secure to the electronics carrier assembly 207, along with the hook 210 and battery door 212.

Figure 3:
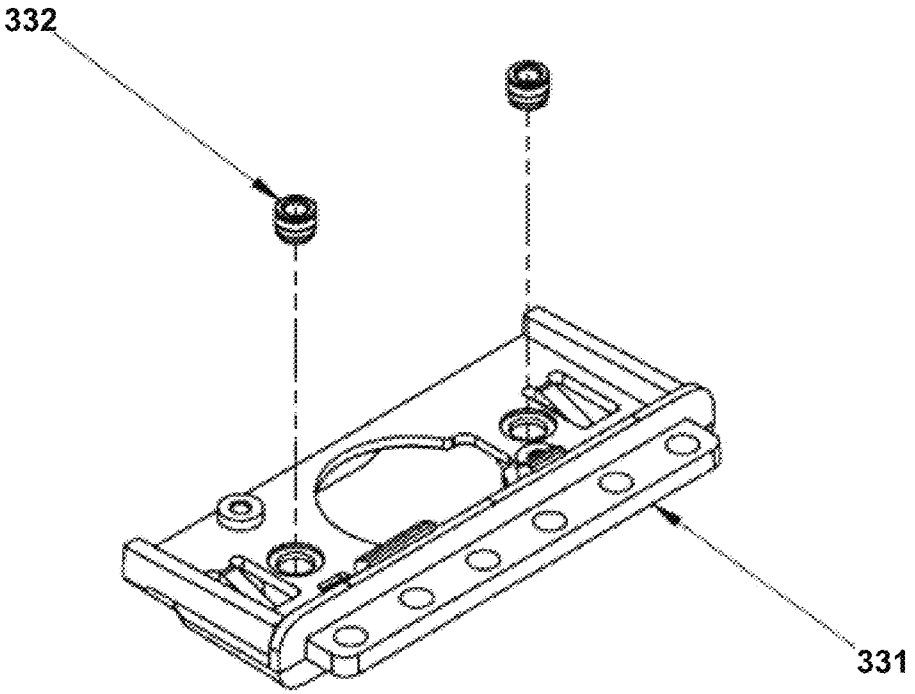
FIG. 3 is a diagram showing an exploded view of a carrier assembly for a smart flexible exercise weight, in accordance with some embodiments.

FIG. 3 is a diagram showing an exploded view of a carrier assembly 307 for a smart flexible exercise weight, in accordance with some embodiments. As shown in FIG. 3, the carrier assembly 331 is configured to be secured to one or more of the components shown in FIG. 1E or FIG. 2 via a pair of mounts 332 (e.g., PEM® fasteners). The protrusion indicated by the arrow 331 is configured to mate with (i.e., to mechanically couple and secure to) a connector region, such as connector region 105A of FIG. 1D.

Figure 4A:
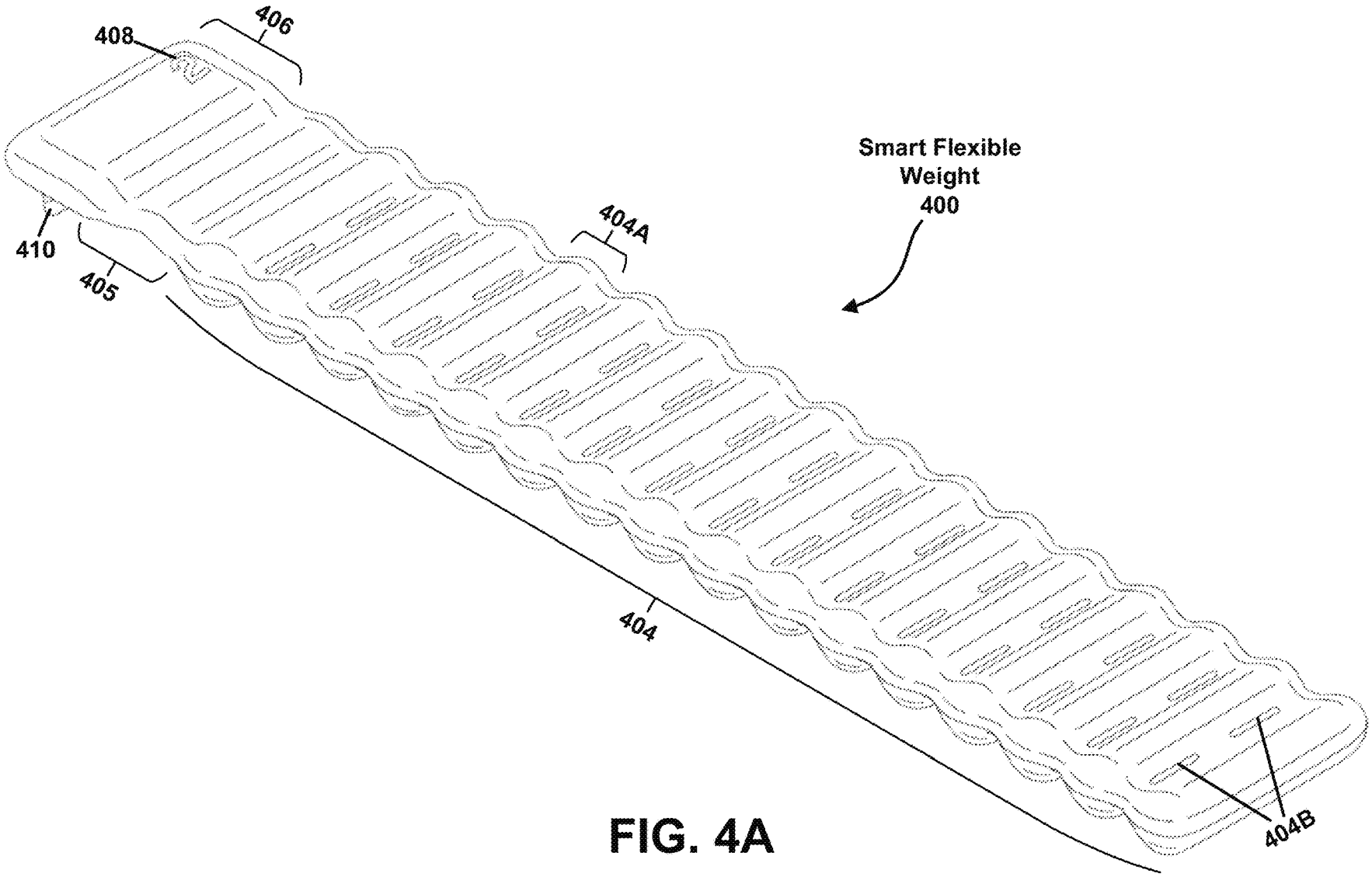
FIG. 4A is a diagram showing a top perspective view of a smart flexible exercise weight, in accordance with some embodiments.
Figure 4B:
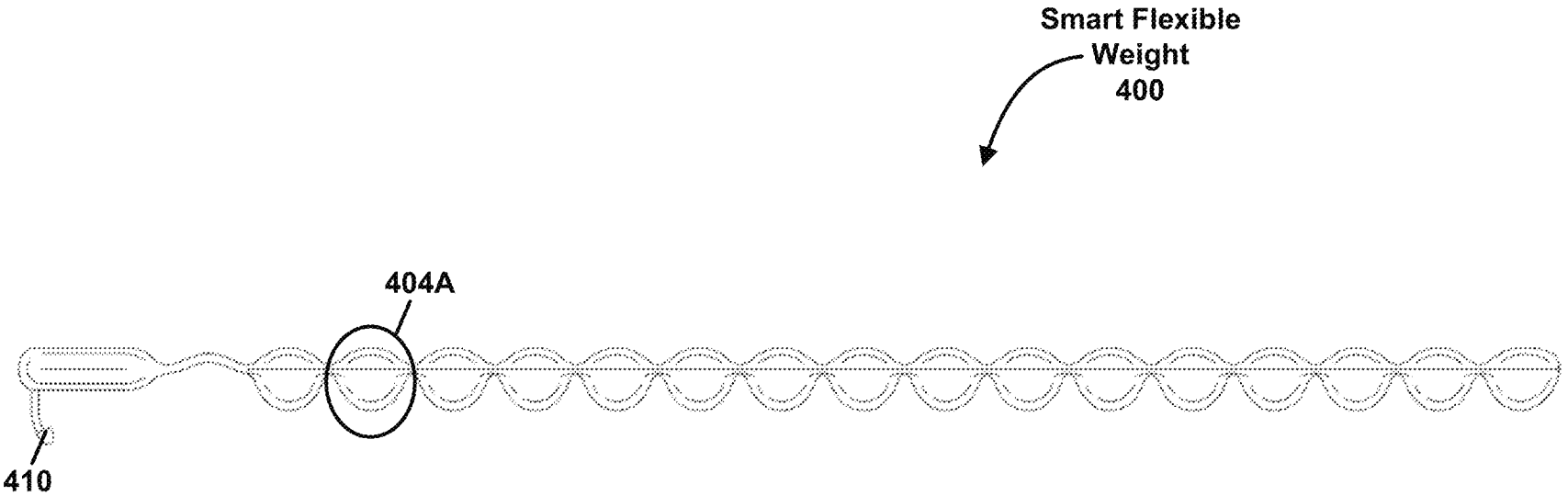
FIG. 4B is a diagram showing a side view of the smart flexible exercise weight of FIG. 4A.
Figures 4C, 4D:
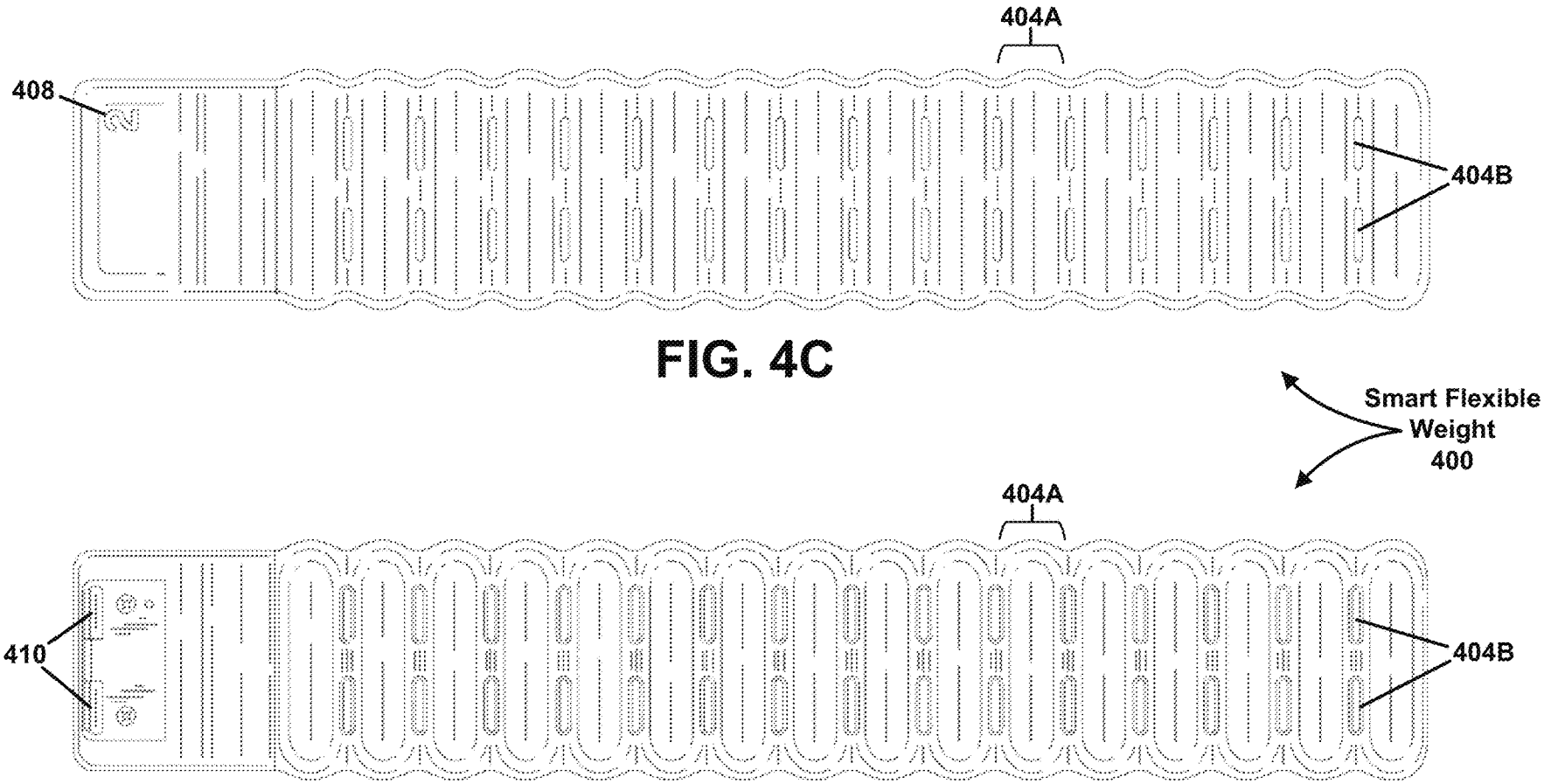
FIG. 4C is a diagram showing a top view of the smart flexible exercise weight of FIG. 4A.
FIG. 4D is a diagram showing a bottom view of the smart flexible exercise weight of FIG. 4A.

FIG. 4A is a diagram showing a top perspective view of a smart flexible exercise weight, in accordance with some embodiments. Similar to FIG. 1A, the smart flexible weight 400 includes an elongate flexible housing portion 404, a plurality of elongate weight sections 404A, a transition section 405 that does not include a weight section 404A, and an end cap 406 with a numeral-shaped indicator portion 408 defined therein. The elongate flexible housing portion 404 includes a plurality of pairs of slots or recesses 404B defined therein, configured to receive a pair of protrusions of a hook fastener. FIG. 4B is a diagram showing a side view of the smart flexible exercise weight of FIG. 4A. FIG. 4C is a diagram showing a top view of the smart flexible exercise weight of FIG. 4A. FIG. 4D is a diagram showing a bottom view of the smart flexible exercise weight of FIG. 4A.

Figure 5B:
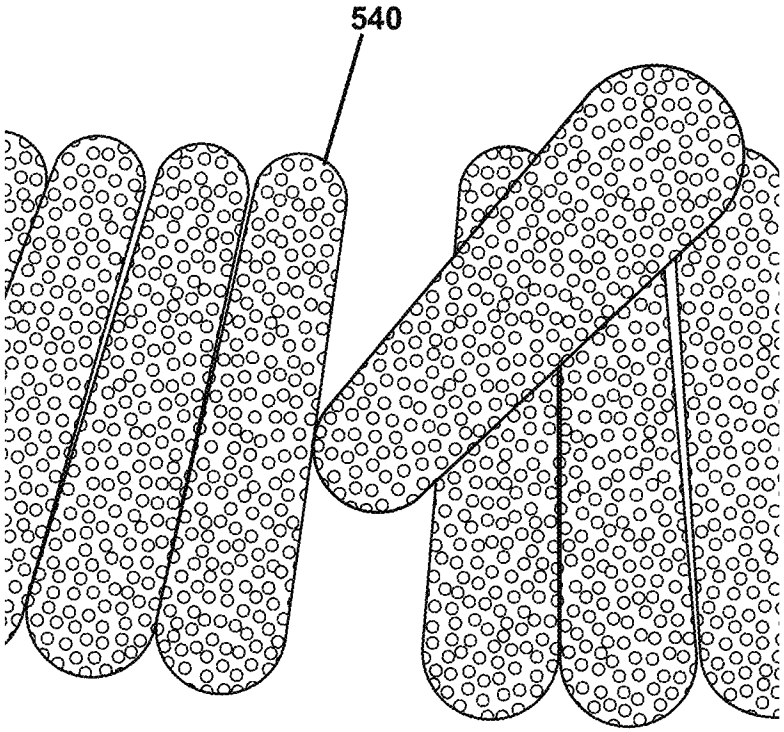
FIGS. 5A-5B are photographs showing a plurality of elongate weights (or "capsules"), in accordance with some embodiments.
Figure 5A:
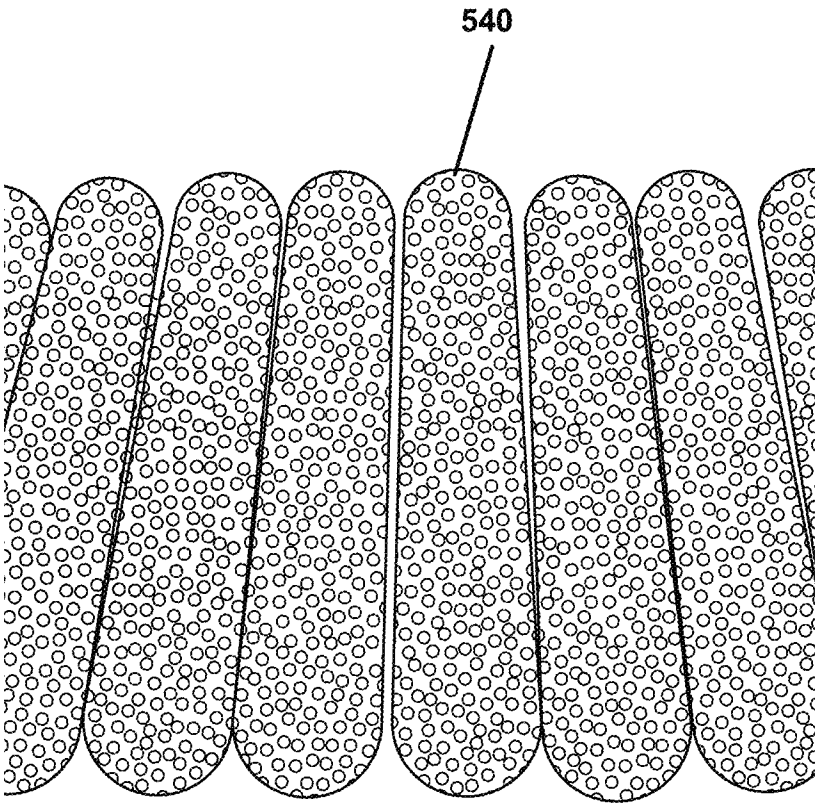
Figure 6:
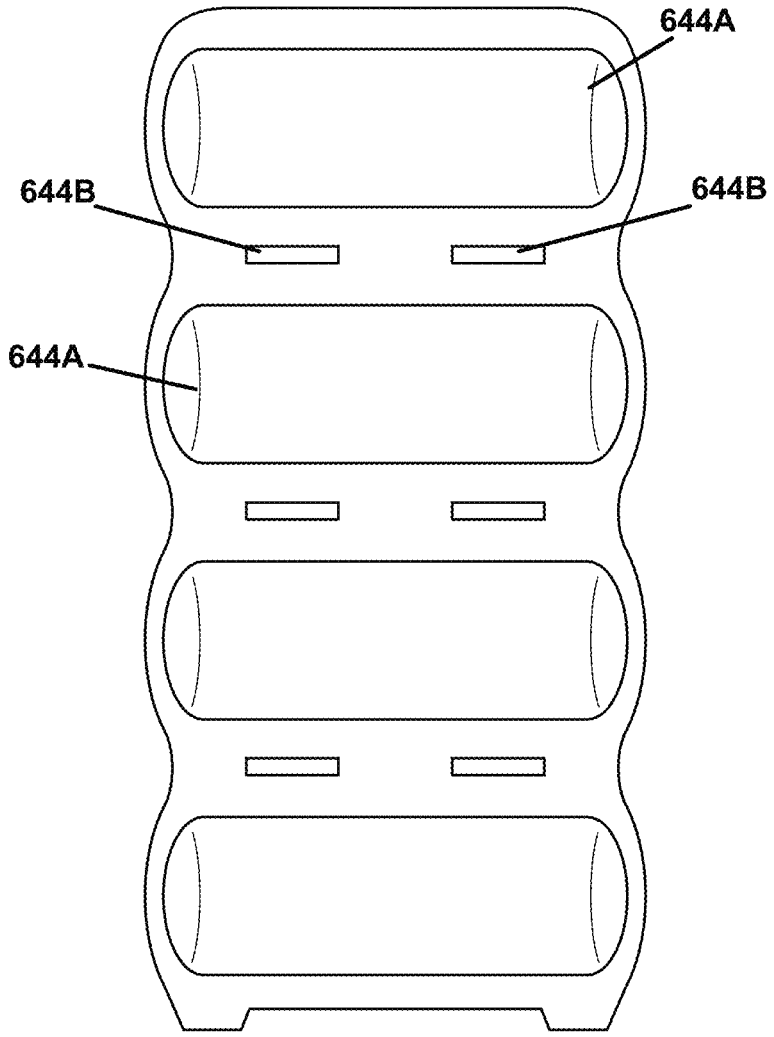
FIG. 6 is a photograph of a lower casing portion of an elongate flexible housing, in accordance with some embodiments.
Figure 7B:
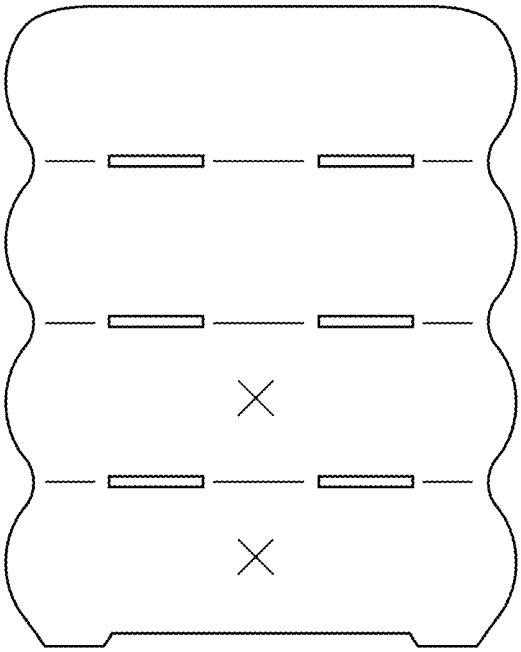
FIGS. 7A-7B are photographs of an over-molded upper casing of an elongate flexible housing during manufacture, in accordance with some embodiments.
Figure 7A:
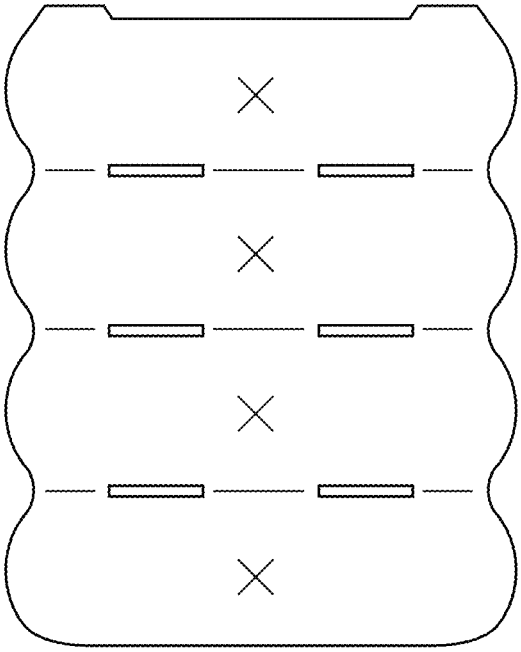

FIGS. 5A-5B are photographs showing a plurality of elongate weights 540 (or "capsules"), in accordance with some embodiments. As can be seen in FIGS. 5A-5B, each of the elongate weights 540 includes a smooth, continuous, closed casing that contains a plurality of tightly-packed pellets embedded within a cured gel. FIG. 6 is a photograph of a lower casing portion of an elongate flexible housing (e.g., similar to 142B in FIG. 1D), in accordance with some embodiments. FIGS. 7A-7B are photographs of a portion of an elongate flexible housing during manufacture, showing an upper casing portion that has been over-molded atop a plurality of elongate weight sections and a lower casing portion, in accordance with some embodiments.

Figure 8:
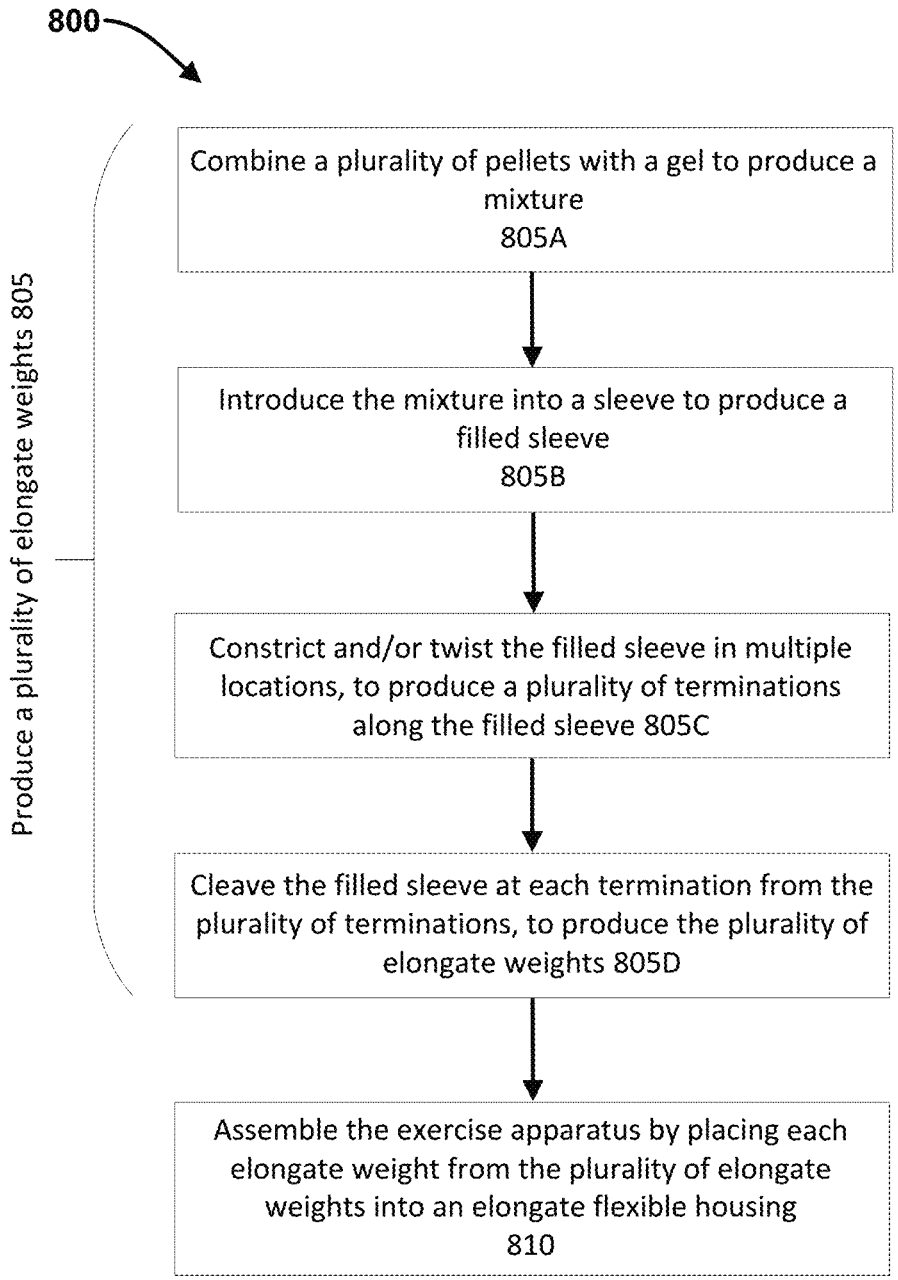
FIG. 8 is a flow diagram of a method for manufacturing a flexible exercise weight, in accordance with some embodiments.

FIG. 8 is a flow diagram of a method for manufacturing a flexible exercise weight (also referred to herein as an "exercise apparatus"), in accordance with some embodiments. As shown in FIG. 8, the method 800 includes producing a plurality of elongate weights 805 and assembling the exercise apparatus at 810 by placing each elongate weight from the plurality of elongate weights into an elongate flexible housing. Optionally, the assembly process also includes over-molding an upper casing of the elongate flexible housing to the plurality of elongate weights and a lower casing of the elongate flexible housing. Alternatively or in addition, the assembly process includes sealing an upper casing of the elongate flexible housing to a lower casing of the elongate flexible housing such that the plurality of elongate weights is positioned between and fully encompassed by the upper casing of the elongate flexible housing and the lower casing of the elongate flexible housing. Alternatively, the assembly process can include sealing a single mated edge of a single-component casing of the elongate flexible about the plurality of elongate weights such that the plurality of elongate weights is fully encompassed by the single-component casing of the elongate flexible housing. Alternatively, the assembly process can include one of gluing, sewing, or fastening (e.g., using one or more fasteners such as snaps, rivets, clips, clamps, etc.) a single mated edge of a single-component casing of the elongate flexible about the plurality of elongate weights such that the plurality of elongate weights is fully encompassed by the single-component casing of the elongate flexible housing.

The producing the plurality of elongate weights 805 includes: combining a plurality of pellets with a gel (e.g., including an elastomer), at 805A, to produce a mixture; introducing the mixture into a sleeve (e.g., via pushing, forcing, extruding, vacuum pulling and/or gravity-feeding the mixture into the sleeve), at 805B, to produce a filled sleeve; at least one of constricting or twisting the filled sleeve in multiple locations, at 805C, to produce a plurality of terminations along the filled sleeve; and cleaving (cutting, separating) the filled sleeve at each termination from the plurality of terminations, at 805D, to produce the plurality of elongate weights. In some implementations, the plurality of pellets includes at least one of steel pellets, lead pellets, or stainless steel pellets.

In some implementations, the production of the mixture at 805A includes causing or allowing the plurality of pellets to at least one of penetrate, sink into, or disperse/distribute within, the gel.

In some implementations, a smart flexible exercise weight includes a processor and a memory storing processor-executable instructions to "pair" (i.e., wirelessly connect, e.g., via via Bluetooth®, Bluetooth Low Energy (BLE), and/or another wireless network communications protocol) the smart flexible exercise weight with a remote compute device, a mobile compute device and/or a smart mirror. The memory can also store processor-executable instructions to perform real-time repetition ("rep") tracking, form correction, motion tracking, motion monitoring, and/or weight recommendations, any of which may be based on a performance of a user of the smart flexible exercise weight. For example, the processor-executable instructions can include instructions to generate/identify one or more weight recommendations (i.e., a recommended amount of weight, such as 2 lbs) and/or to identify one or more adjustment recommendations for the smart flexible exercise weight (i.e., a recommended wear configuration, such as "wear position 1" (e.g., representing the pair of slots or recesses 104B closest to the end cap 106 in FIG. 1A), "wear position 5" (e.g., representing the pair of slots or recesses 104B fifth-closest to the end cap 106 in FIG. 1A), etc., based on one or more of: a trained machine learning model (e.g., based on historical data associated with a given user or multiple users, crowd-sourced performance data, etc.), a user preference, a type of exercise routine currently displayed via a smart mirror or mobile app, a type of exercise routine next scheduled, a type of exercise routine selected by the user, etc. A signal representing the one or more weight recommendations and/or adjustment recommendations can be transmitted from the smart flexible exercise weight to at least one of a remote compute device, a smart mirror, or a mobile app, for display via an interface (e.g., a graphical user interface (GUI)) thereof. Alternatively or in addition, at least one of a remote compute device, a smart mirror, or a mobile app associated with the user can store instructions to generate/identify the one or more weight recommendations and/or adjustment recommendations discussed above, and optionally stores instructions to cause transmission of signals representing the recommendations to the smart flexible exercise weight (e.g., for display via a GUI thereof) and/or to the other(s) of the at least one of the remote compute device, the smart mirror, or the mobile app.

Optionally, the smart flexible exercise weight also includes one or more sensors, one or more light-emitting diodes (LEDs), and/or a Bluetooth® transceiver. The one or more sensors can include an inertial measurement unit (IMU). For example, a 9-axis IMU may be used, which includes a 3-axis gyroscope, and 3-axis accelerometer, and a 3-axis magnetometer. Using a wireless connection (e.g., Bluetooth® or BLE), the smart flexible exercise weight can transmit position data from the IMU to the remote compute device, mobile compute device and/or smart mirror for further processing. Alternatively or in addition, the one or more sensors can include one or more gyroscopes, one or more accelerometers, one or more magnetometers, one or more pressure sensors, one or more vibration sensors, and/or one or more temperature sensors. Using a wireless connection (e.g., Bluetooth® or BLE), the smart flexible exercise weight can transmit sensor data to the remote compute device, mobile compute device and/or smart mirror for further processing.

In some embodiments, a set of smart flexible exercise weights includes one or more of: a one pound (1 lb) smart flexible exercise weight, a 2 lb smart flexible exercise weight, a 3 lb smart flexible exercise weight, a 4 lb smart flexible exercise weight, or a 5 lb smart flexible exercise weight.

In some embodiments, a set of exercise weights includes one or more of: a 1 lb smart flexible exercise weight, a 1 lb smart dumbbell, a 2 lb smart flexible exercise weight, a 2 lb smart dumbbell, a 3 lb smart dumbbell, a 5 lb smart dumbbell, a 10 lb smart dumbbell, a 15 lb smart dumbbell, a 20 lb smart dumbbell, a 25 lb smart dumbbell, a 30 lb smart dumbbell, a 35 lb smart dumbbell, a 40 lb smart dumbbell, a 45 lb smart dumbbell, or a 50 lb smart dumbbell. The smart dumbbells can include embedded sensors (including one or more of: a gyroscope, an accelerometer, a magnetometer, a pressure sensor, a vibration sensor, and/or a temperature sensor), one or more LEDs, and/or a Bluetooth® transceiver (e.g., for motion tracking and/or monitoring). In some implementations, the smart dumbbells have a fixed weight value (i.e., the weight of the smart dumbbells is not adjustable). In other implementations, the weights of the smart dumbbells can be adjusted.

In some implementations, a smart flexible exercise weight includes a processor and a memory storing processor-executable instructions to operate one or more LEDs as an indicator during use of the smart flexible exercise weight. For example, the processor-executable instructions can include instructions to cause the processor to turn on (activate) the one or more LEDs (optionally at a selected predefined wavelength/color of illumination, such as red, green, blue, yellow, orange, violet, white, etc.) in response to detecting that the smart flexible exercise weight is in use (e.g., based on sensor data, such as accelerometer data). Alternatively or in addition, the processor-executable instructions can include instructions to cause the processor to turn on (activate) the one or more LEDs (optionally at a selected predefined wavelength/color of illumination, such as red, green, blue, yellow, orange, violet, white, etc.) in response to one or more of: detecting that a battery charge level of the smart flexible exercise weight is below a predefined threshold, detecting that the smart flexible exercise weight has successfully paired with a smart mirror, or detecting that an attempt to pair the smart flexible exercise weight with a smart mirror has failed or timed out.

In some embodiments, after a smart flexible exercise weight has successfully paired with a smart mirror, at least one of the smart flexible exercise weight or the smart mirror can be configured (e.g., via software and/or hardware) to generate a waveform (also referred to herein as a "wave pattern" and used to represent a motion of the smart flexible exercise weight of the user) and/or to count repetitions ("repetition counting") of a movement of the smart flexible exercise weight, based on data detected at the smart flexible exercise weight (e.g., sensor data, such as IMU position data) and, optionally, based on data received via at least one additional smart flexible exercise weight. The generation of the waveform can be performed using a peak detection algorithm or model. In some such implementations, the peak detection algorithm or model has been trained to adapt to a detected or specified exercise type associated with the movement of the smart flexible exercise weight. For example, machine learning may be used to train a peak detection model to recognize periods of time in which the smart flexible exercise weight is moving in a first direction, periods of time in which the smart flexible exercise weight is moving in a second direction different from the first direction, and transition or inflection periods during which the smart flexible exercise weight is changing from the first direction to the second direction or from the second direction to the first direction. A repetition can be defined, for example, as a sequential pair of transition or inflection periods, or as a single occurrence of a transition or inflection period. In other such implementations, a plurality of peak detection algorithms may be stored in or accessible to the smart flexible exercise weight and/or the smart mirror, and a peak detection algorithm from the plurality of peak detection algorithms can be automatically selected based on a detected or specified exercise type associated with the movement of the smart flexible exercise weight. By tailoring the algorithm to the specific exercise being performed, a higher precision repetition count can be obtained.

Optionally, the at least one of the smart flexible exercise weight or the smart mirror can also be configured (e.g., via software and/or hardware) to detect that the user is moving the smart flexible exercise weight too rapidly or too slowly, e.g., based on the repetition count discussed above. In response to detecting that the user is moving the smart flexible exercise weight too rapidly, the at least one of the smart flexible exercise weight or the smart mirror may generate and display (or cause transmission of) a message recommending that the user switch to a heavier weight and/or recommending that the user modify an aspect of their movement (e.g., "slow down"). Similarly, in response to detecting that the user is moving the smart flexible exercise weight too slowly, the at least one of the smart flexible exercise weight or the smart mirror may generate and display (or cause transmission) of a message recommending that the user switch to a lighter weight and/or recommending that the user modify an aspect of their movement (e.g., "speed up").

Optionally, the at least one of the smart flexible exercise weight or the smart mirror can also be configured (e.g., via software and/or hardware) to detect vibration associated with muscle fatigue or muscle failure. Such vibration may have a predefined "signature," for example depending on the sensor(s) used, and the signature can include a magnitude, frequency and/or duration of the vibration. In response to detecting no such vibration, the at least one of the smart flexible exercise weight or the smart mirror may generate and display (or cause transmission of) a message recommending that the user switch to a heavier weight and/or recommending that the user modify an aspect of their movement (e.g., "slow down"). In response to detecting such vibration too early within a given exercise period (e.g., "set" of repetitions), the at least one of the smart flexible exercise weight or the smart mirror may generate and display (or cause transmission of) a message recommending that the user switch to a lighter weight and/or recommending that the user modify an aspect of their movement (e.g., "slow down"). In response to detecting such vibration at a preferred time within a given exercise period (e.g., "set" of repetitions), the at least one of the smart flexible exercise weight or the smart mirror may generate and display (or cause transmission of) a message of encouragement to the user and/or cause storage of an indication that the weight is appropriate for that user, for that particular exercise (collectively, "weight data"), so that the weight data can be retrieved at a later time, for example for use in generating and displaying weight recommendations for the same or different exercises.

Optionally, the at least one of the smart flexible exercise weight or the smart mirror can also be configured (e.g., via software and/or hardware) to detect an anomalous event or activity ("anomaly") associated with the user's movement of the smart flexible exercise weight, e.g., based on the repetition count discussed above. For example, if a detected pattern of movement of the smart flexible exercise weight deviates by more than a predefined amount from a target pattern, the peak detection algorithm or model may generate and/or select a form correction recommendation (or "form tip") and cause display of a message representing the form tip. An example of a form tip message is "pull your elbows in while doing a bicep curl."

In some implementations, electronics are housed in an end-cap portion of the smart flexible exercise weight. The end-cap portion of the smart flexible exercise weight includes a numeral-shaped region that can be a cutout region or an integrally-formed window that is transparent or translucent to light. The electronics can include one or more variable light output frequency LEDs that, when illuminated, cause light to transmit the numeral-shaped region. The numeral-shaped region can represent the physical weight of the smart flexible exercise weight (i.e., a 5 lb smart flexible exercise weight can include a numeral-shaped region in the shape of a "5").

In one implementation, the smart flexible exercise weight includes a housing with an undulating wave shape/profile and is filled with a plurality of highly flexible capsules each including a cured suspension of steel shot and an elastomer (e.g., rubber and/or silicone) binder within a flexible casing (e.g., a plastic casing). The plurality of highly flexible capsules can be encased in the wave-shaped housing via injection molding or other suitable method.

In some embodiments, the elastomer, when cured, has a durometer value of between about 20 and about 100, or of between about 30 and about 70, or of between about 30 and about 50, or of between about 50 and about 70.

In some embodiments, a method of manufacturing a smart flexible exercise weight includes molding a lower portion of a casing and (in parallel or sequentially) producing a plurality of elongate weights. The lower portion of the casing can include a plurality of recesses, each recess from the plurality of recesses sized and shaped to accommodate an elongate weight from the plurality of elongate weights. Each elongate weight from the plurality of elongate weights is positioned within an associated recess from the plurality of recesses, and an upper portion of the casing (e.g., having a similar size and shape as the lower portion of the casing) is over-molded over the lower portion of the casing and the plurality of elongate weights and an electronics adapter (e.g., a plastic electronics adapter). The electronics/end cap can then be assembled to the electronics adapter.

Universal Health Score (UHS)

In some embodiments, at least one of the smart flexible exercise weight or the smart mirror can be configured (e.g., via software and/or hardware) to calculate a Universal Health Score (UHS). The UHS is a holistic way of tracking a user's progress through a measurement of cardio, strength, and recovery metrics. As an example, during a given fitness class (e.g., a streamed and/or broadcast fitness class displayed via a smart mirror) or exercise period (i.e., a "workout"), a composite score of cardio, strength and/or recovery points for the user can be displayed via the smart mirror or a mobile compute device of the user. The composite score can be based on the types of exercises included within that workout. The user's "Class Score" at the end of the workout may be added to a "Total Health Score" of the user and saved in a memory of the at least one of the smart flexible exercise weight or the smart mirror, and/or the mobile compute device of the user.

Each workout can include a plurality of exercises, and each exercise can be assigned a health type of heart, muscle or recovery. Points associated with each health type can be calculated differently based on a performance of the user. In some implementations, if it is determined (e.g., by the at least one of the smart flexible exercise weight or the smart mirror) that the user does not have a connected peripheral device (e.g., a heart rate monitor, a smart flexible exercise weight, a smart dumbbell, or another biometric sensor), the score(s) may be reduced (e.g., halved). Example calculation details for each exercise type are as follows:

Heart

In some embodiments, points are earned if a user keep their heart rate in the designated heart rate zone according to the formula:

$$Ph=0.0278*(tz/(tz+\text{abs}(tz-mz))+0.5L),$$

where Ph refers to "heart points," tz is the target heart rate zone for the exercise, mz is the current heart rate zone of the member based on their current heart rate, and L is the exercise level.

Muscle

In some embodiments, points are earned as a user does repetitions with weights. If the exercise has no repetitions (e.g., during a plank), the user's score is based on time spent performing the exercise, rather than based on repetitions. When counting repetitions, heavier weights are rewarded with higher point values according to the formula:

$$Pm=(0.0556/R)*(tw/(tw+(tw-mw))+0.5L),$$

where Pm refers to "muscle points," R is the expected repetition rate per second (with an optional default value of, for example, 2), tw is the target weight for the exercise times the number of weights, mw is the weight in use times the number of weights, and L is the exercise level. If no connected weights (i.e., smart flexible weights and/or smart dumbbells) are active, then the weight value mw is set to be the target weight value (tw), but the points are reduced (e.g., halved) before being applied.

Recovery

In some embodiments, points are earned for time spent during recovery exercises according to the formula:

$$Pr=0.0278*0.5L,$$

where Pr refers to "recovery points" and L is the exercise level.

The composite score can be calculated based on each of Ph, Pm, and Pr (e.g., by summing their values, averaging their values, taking a weighted average of their values, etc.).

Smart Mirrors

A "smart mirror," as used herein, refers to a two-way mirror (e.g., comprising glass) and an electronic display that is at least partially aligned with (and disposed behind, from the point of view of a user) the two-way mirror, such that the user can simultaneously view his/her own reflection and the imagery/video presented via the electronic display during operation of the smart mirror. Additional details regarding the construction and operation of a smart mirror can be found, by way of example, in U.S. Pat. No. 10,758,780, issued Mar. 12, 2020 and titled "Reflective Video Display Apparatus for Interactive Training and Demonstration and Method of Using Same," and in U.S. Pat. No. 11,167,172, issuing Nov. 9, 2021 and titled "Video Rebroadcasting with Multiplexed Communications and Display via Smart Mirrors," the entire contents of which are incorporated by reference herein for all purposes. As discussed herein, smart mirrors can connect wirelessly with connected weights (i.e., smart flexible weights and/or smart dumbbells) described herein, and can be configured to display data derived from the user of the connected weights.

Figure 9:
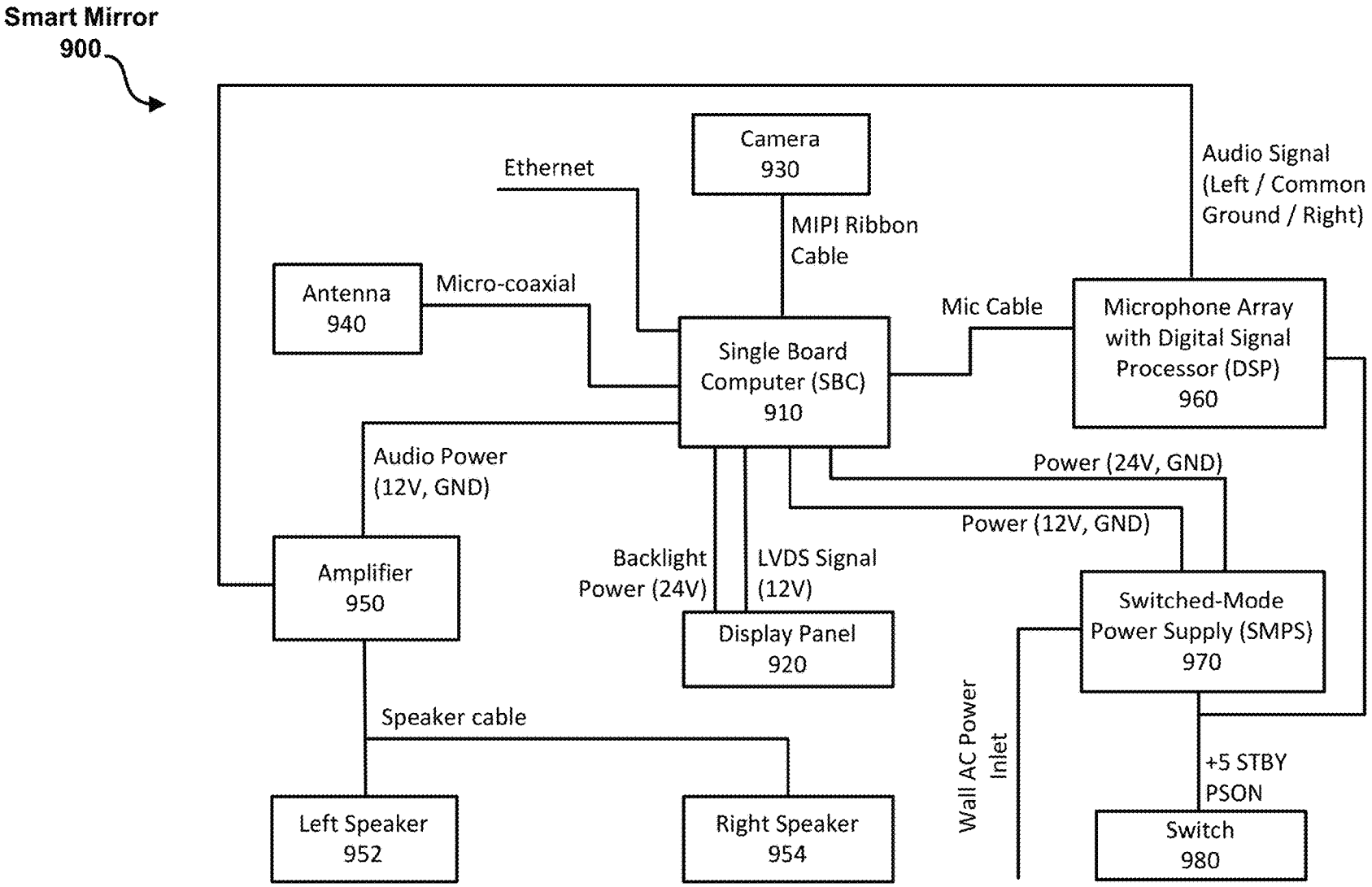
FIG. 9 is a diagram of a smart mirror, in accordance with some embodiments.

FIG. 9 is a diagram of a smart mirror, in accordance with some embodiments. As shown in FIG. 9, the smart mirror 900 includes a single board computer (SBC) 910 that controls, at least in part, the operation of various subcomponents of the smart mirror 900 and to manage the flow of content to/from the smart mirror 900 (e.g., video content, audio from one or more instructors and/or users, biometric sensor data, etc.). The smart mirror 900 includes a display panel 920 configured to display video content and a graphical user interface (GUI) with which users may interact to control the smart mirror 900, for example to view biometric feedback data and/or other visual content, to select content for display, etc. The smart mirror 900 also includes a camera 930 operably coupled to the SBC 910 and configured (e.g., under control of the SBC 910) to record or live stream video and/or images of a user (e.g., while the user is exercising during a workout session). An antenna 940 is operably coupled to the SBC 910 and configured to facilitate communications between the smart mirror 900 and another device (e.g., a remote compute device, one or more other smart mirrors, a remote control device, one or more biometric sensors, a wireless router, one or more mobile compute devices, etc.) by transmitting and receiving signals representing messages. For example, one or more wireless connections to one or more smart flexible exercise weights can be established via antenna 940, and data can be received from the one or more smart flexible exercise weights via antenna 940. The antenna 940 can include multiple transmitters and receivers each configured to transmit/receive at a specific frequency and/or using a specific wireless standard (e.g., Bluetooth®, 802.11a, 802.11b, 802.11g, 802.11n, 802.11 ac, 2G, 3G, 4G, 4G LTE, 5G). The antenna 140 may include multiple antennas that each function as a receiver and/or a transmitter to communicate with various external devices, such as a user's smart device (e.g., a computer, a smart phone, a tablet), a biometric sensor (e.g., a heart rate monitor, a vibration sensor, or any other sensor described herein), and/or a remote server or cloud server to stream or play video content. An amplifier 950 is operably coupled to the SBC 910, a left speaker 952, a right speaker 954, and a microphone array with a digital signal processor 960, The amplifier 950 is configured to receive audio signals from the SBC 910 and route them for subsequent output through the left speaker 952 and/or the right speaker 954. The microphone array 960 can be configured to detect audio/voice, including voice commands and/or other voice inputs made by one or more users within sufficient proximity of the smart mirror 900. For example, the microphone array 960 can detect voice commands to start/stop a workout, voice communications to the instructor, voice commands to turn the display panel on/off, voice commands to change a layout of the GUI, voice commands to trigger an invitation to another smart mirror user to participate in a workout session, etc. The microphone array 960 is operably coupled to, and controllable by, the SBC 910. A switched-mode power supply (SMPS) 970 is coupled to the SBC 910 and coupled to relay (and, optionally, regulate delivery of) electrical power from an external electrical power supply system (e.g., a wall outlet) to the various components of the smart mirror 900. A switch 980 may be coupled to the SMPS 970 and/or the microphone array 960 to switch the smart mirror 900 and the microphone array 960 on and off Although shown and described in FIG. 9 as including a single board computer 910, in other embodiments the smart mirror 900 can include one or multiple processors and one or multiple memories operably coupled to the one or multiple processors.

In some embodiments, the smart mirror 900 also includes one or more additional components not shown in FIG. 9. For example, the smart mirror 900 may include onboard memory storage (nonvolatile memory and/or volatile memory) including, but not limited to, a hard disk drive (HDD), a solid state drive (SDD), flash memory, random access memory (RAM), or a secure digital (SD) card. This onboard memory storage may be used to store firmware and/or software for the operation of the smart mirror 900. As described above, the onboard memory storage may also be used to store (temporarily and/or permanently) other data including, but not limited to, video content, audio, video of the user, biometric feedback data, and user settings. The smart mirror 900 may also include a frame to mount and support the various components of the smart mirror 900.

In some embodiments, connected weights described herein (i.e., smart flexible weights and/or smart dumbbells) can include a microcontroller communicably coupled to a plurality of sensors (optionally including at least one "onboard" sensor) and configured to communicate with one or more smart mirrors, optionally after being paired with the one or more smart mirrors. The plurality of sensors can include sensors for detecting data that directly measures, or is used in the calculation of, one or more of the following non-exhaustive list of biometric data: position (e.g., via a global positioning system (GPS) sensor, altimeter, etc.), orientation or rotation (e.g., via a gyroscope, magnetometer, etc.), acceleration (e.g., via 3-axis accelerometer(s)), speed/velocity (e.g., limb speed, running speed, etc.), cadence, pace, gait, vibration, salinity, breathing rate, heart rate (e.g. via a bioimpedance sensor, optical sensor, photoplethysmography (PPS) sensor, etc.), muscle twitch response, heart rate recovery, perspiration rate, intensity, linear force, linear movement, rotational force, rotational movement, power (e.g., running power), repetition counts, range of motion, movement patterns/trajectories, gestures, facial features (e.g., via facial recognition sensors), flexibility, endurance, strength, body fat, and hydration level.

In some embodiments, connected weights include multiple biometric connector sensors, each configured to communicate (e.g., via Bluetooth® or other wireless network communications protocol) with one or more smart mirrors and/or with any other wall-mounted or freestanding appliance (including, but not limited to, other types of exercise equipment having a display monitor/screen). The one or more smart mirrors (and/or an app running on the smart mirror(s), and/or mobile compute device(s) of the user(s)), upon receipt of data from the connected weights, may detect a type of exercise equipment (e.g., a weight type) associated with the data, and select an algorithm and/or rule set for interpreting the data based on the detected type of exercise equipment.

In some embodiments, biometric data is gathered, over time, from each of a plurality of networked smart mirrors and/or from any other wall-mounted or freestanding appliance (including, but not limited to, other types of exercise equipment having a display monitor/screen) and for each of a plurality of smart mirror users, and stored in a centralized repository (e.g., a cloud server). One or more machine learning models can be trained using the stored biometric data, to produce one or more trained machine learning models. The one or more trained machine learning models can detect, optionally adaptively over time (by retraining the one or more trained machine learning models based on additional biometric data gathered since the previous machine learning training), trends among subgroups of smart mirror users, such as: workout popularity, low performance statistics for individual workouts, high performance statistics for individual workouts, high interaction with other users during certain time periods, high interaction with other users during certain workouts, high interaction with other users on certain days, high interaction with other users for certain instructors, etc.

In some embodiments, biometric data is gathered, over time, from each of a plurality of networked smart mirrors and/or from any other wall-mounted or freestanding appliance (including, but not limited to, other types of exercise equipment) having a display monitor/screen) and for each of a plurality of smart mirror users, and stored in a centralized repository (e.g., a cloud server). One or more machine learning models can be trained using a subset of the stored biometric data, the subset of the stored biometric data being selected based on one or more properties of a given user (e.g., biometric data, age, gender, height, weight, workout preferences, past workout performance, fitness level, etc.) to produce one or more trained machine learning models. The one or more trained machine learning models can then generate, optionally adaptively over time (by retraining the one or more trained machine learning models based on additional biometric data gathered since the previous machine learning training), recommendations for the user, including one or more of (but not limited to): recommended modifications to form (e.g., body positioning), workout recommendations, instructor recommendations, "friend" (i.e., other smart mirror user) recommendations, etc. The recommendations can also be based, in part, on one or more predefined user-customizable goals. For example, the trained machine learning model(s) can generate recommendations that are predicted to result in the user moving closer to his/her goal(s). Examples of user-customizable goals can include metrics such as (but not limited to): fitness level, mastery score (discussed further below), sport-specific fitness level (e.g., specific to yoga, running, calisthenics, cycling, biometric data (e.g., during the performance of one or more specified workouts), sport-specific form, sport-specific performance, workout-specific form, workout-specific performance, exercise-specific form, or exercise-specific performance. In some implementations, a first user can customize his/her goals by inputting (via a GUI of the smart mirror or mobile compute device) a name or identifier of one or more other smart mirror users, along with the metric(s) of that other smart mirror user that the first user would like to attain or progress toward.

Figure 10:
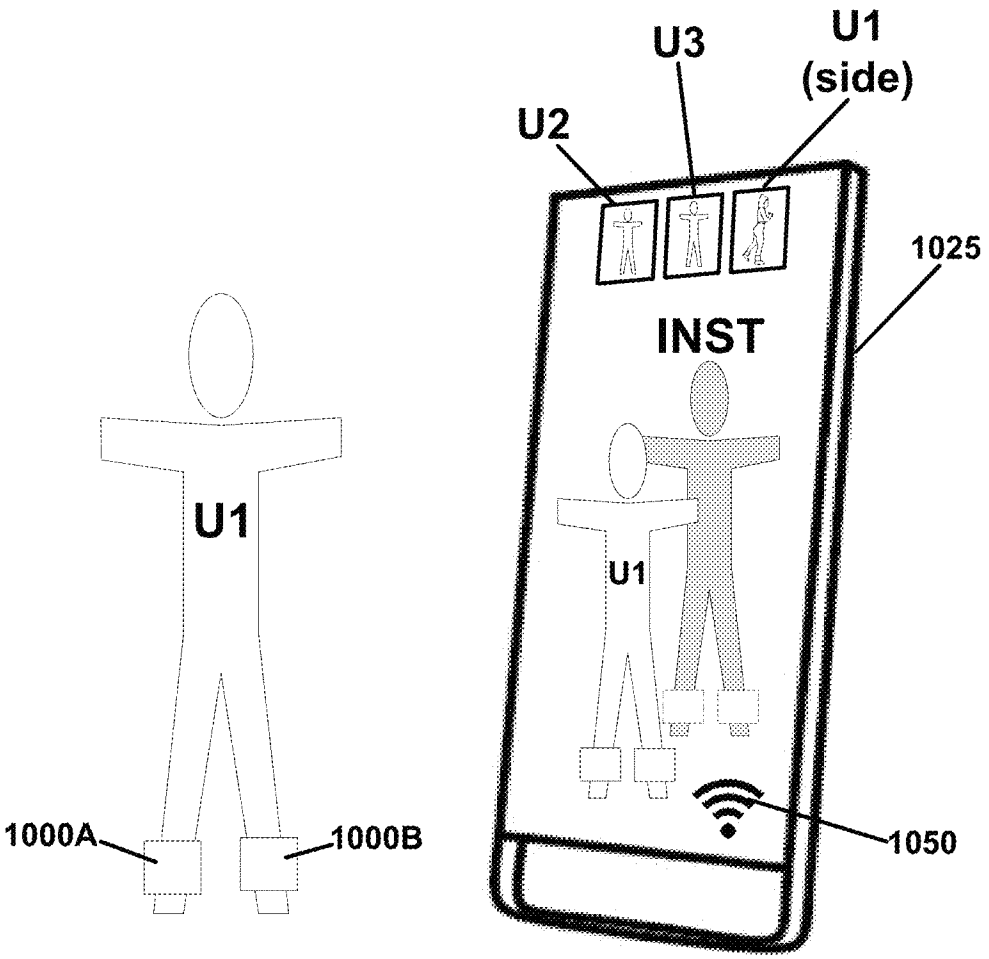
FIG. 10 is a block diagram showing a user wearing a pair of smart flexible exercise weights and interacting with a smart mirror, in accordance with some embodiments.

FIG. 10 is a block diagram showing a user U1 wearing a pair of smart flexible exercise weights 1000A and 1000B (e.g., the smart flexible weight 100 of FIG. 1A) and interacting with a smart mirror, in accordance with some embodiments. The smart mirror 1025 displays a reflected image of user U1, video imagery of an exercise instructor INST (e.g., live streamed video, broadcast pre-recorded video, etc.), panels depicting live or pre-recorded video imagery of two additional users, U2 and U3, each geographically remote from user U1. The video imagery of the two additional users U2 and U3 can be video recorded via cameras of two additional smart mirrors associated with the two additional users U2 and U3. The smart mirror 1025 also displays a panel depicting imagery of user U1 from a different perspective than is shown in the reflected image of user U1. For example, the panel depicting the imagery of user U1 can show a side view of the user either captured via a video camera external to the smart mirror 1025, or generated based on data generated by the smart flexible exercise weights 1000A and 1000B (e.g., in the form of an animation, a reconstruction, a vector representation, a ghosted image, etc., in 2-D or in 3-D) and transmitted to the smart mirror 1025. Generation of such user appearance data without camera/video imagery can be accomplished using the data generated by the smart flexible exercise weight(s), optionally in combination with data received at the smart mirror from one or more of: smart textiles/garments (i.e., fabric-based sensors), wearable electronics, wearable IMUs, biometric sensors, etc.

Figure 11:
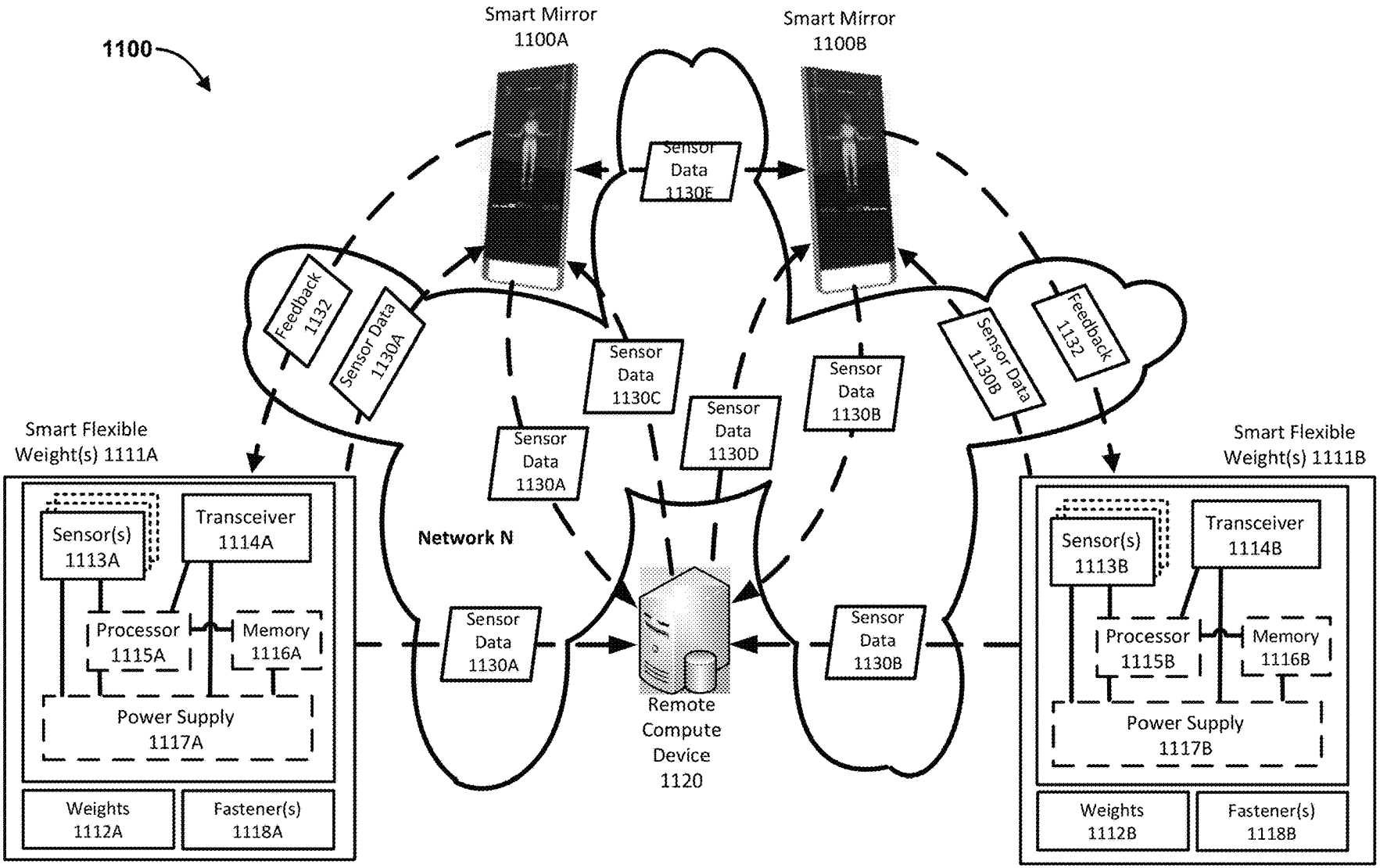
FIG. 11 is a system diagram showing interactions among smart flexible weights, smart mirrors, and a remote compute device, in accordance with some embodiments.

FIG. 11 is a system diagram showing interactions among smart flexible weights, smart mirrors, and a remote compute device, in accordance with some embodiments. The system 1100 includes smart mirrors 1100A and 1100B, smart flexible weight(s) 1111A, smart flexible weight(s) 1111B, and a remote compute device 1120, each in operable communication with one another (e.g., via wireless network communication) via network N. Each of the smart flexible weight(s) 1111A includes one or more sensors 1113A, a transceiver 1114A, a processor 1115A operably coupled to a memory 1116A, a power supply 1117A (e.g., a battery), weights 1112A (e.g., elongate weights 140 of FIG. 1D), and one or more fasteners 1118A (e.g., fastener 110 of FIG. 1E). Similarly, each of the smart flexible weight(s) 1111B includes one or more sensors 1113B, a transceiver 1114B, a processor 1115B operably coupled to a memory 1116B, a power supply 1117B (e.g., a battery), weights 1112B (e.g., elongate weights 140 of FIG. 1D), and one or more fasteners 1118B (e.g., fastener 110 of FIG. 1E). Sensor data generated by the sensors 1113A and/or 1113B can be transmitted from the associated smart flexible weights 1111A, 1111B to any of the smart mirror 1100A, smart mirror 1100B, and/or the remote compute device 1120 (see sensor data 1130A, 1130B), sensor data 1130E can be exchanged between the smart mirrors 1100A, 1100B, and/or sensor data 1130A, 1130B can be sent from the smart mirrors 1100A, 1100B to the remote compute device 1120 for further processing, algorithmic processing, retraining of machine learning models, the generation of feedback and/or the display of representations of the data and/or feedback. The feedback can include form corrections, performance indications/ratings, statistics relative to other users, historical data, etc.

Figure 12B:
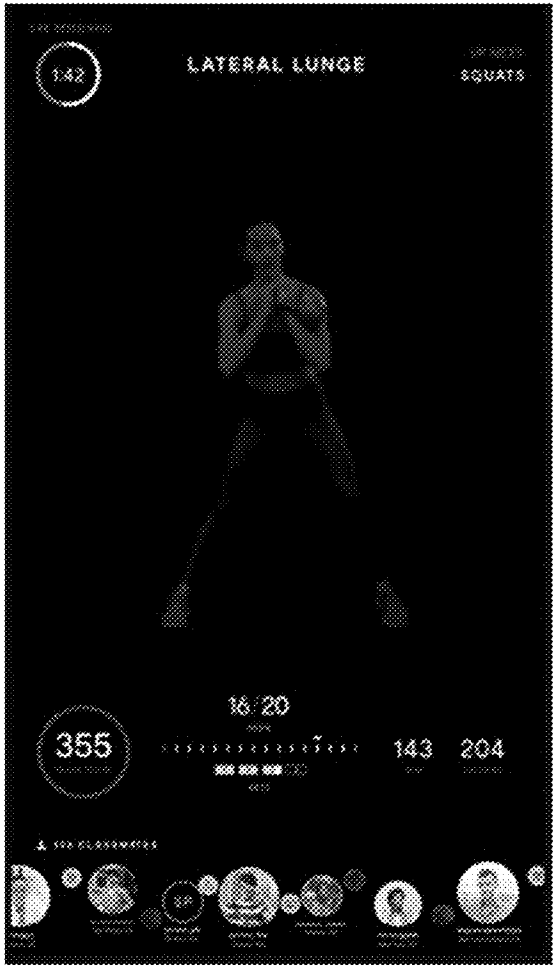
FIGS. 12A-12G are example graphical user interface (GUI) displays showing the generation and display of a universal health score, in accordance with some embodiments.
Figure 12A:
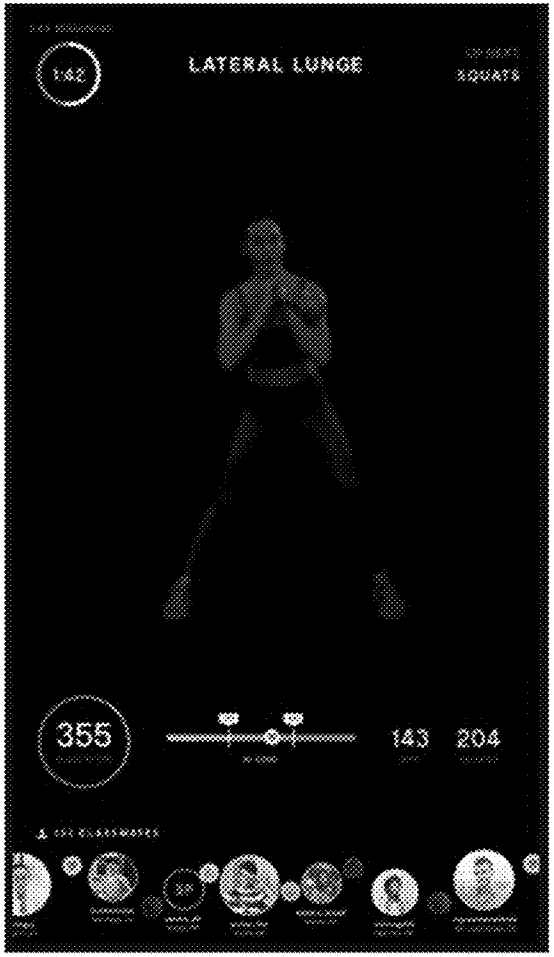
Figure 12D:
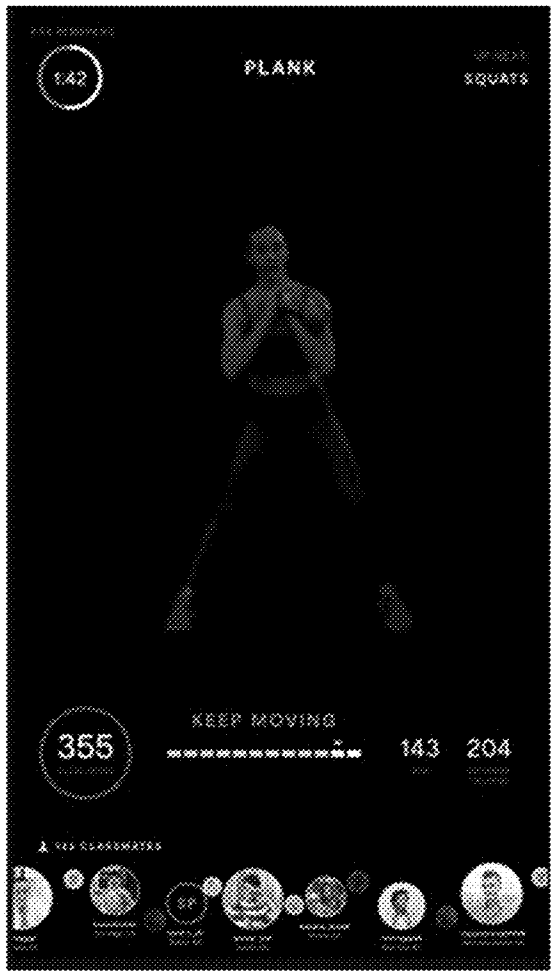
Figure 12C:
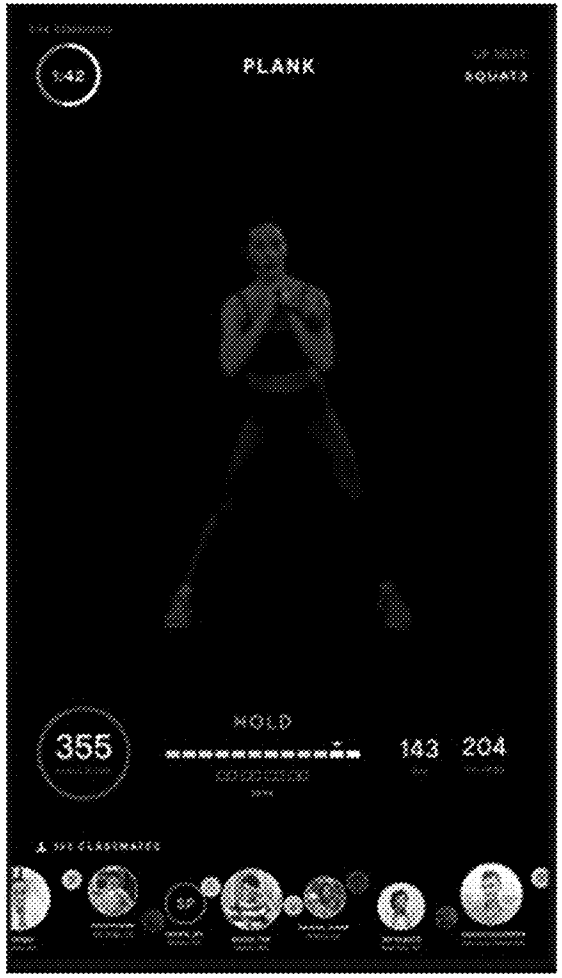
Figure 12F:
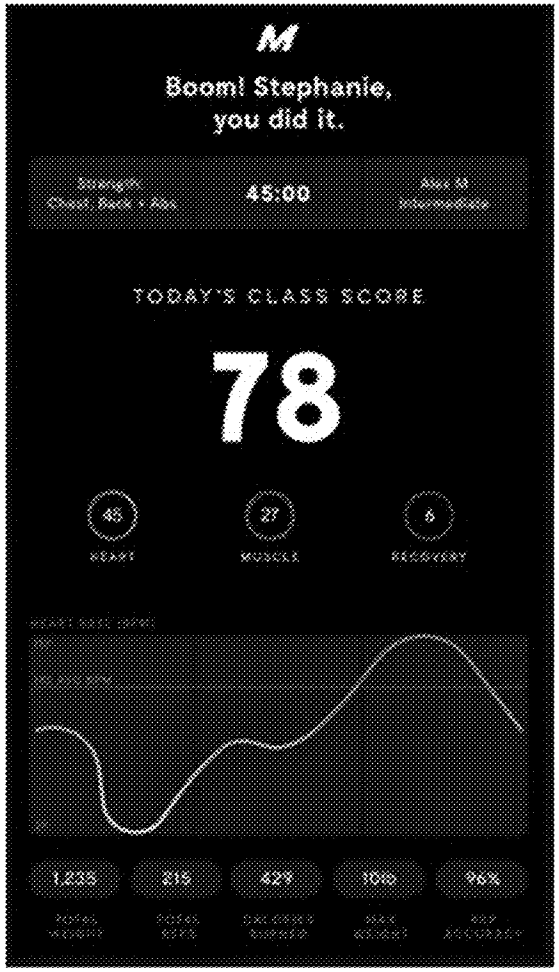
Figure 12E:
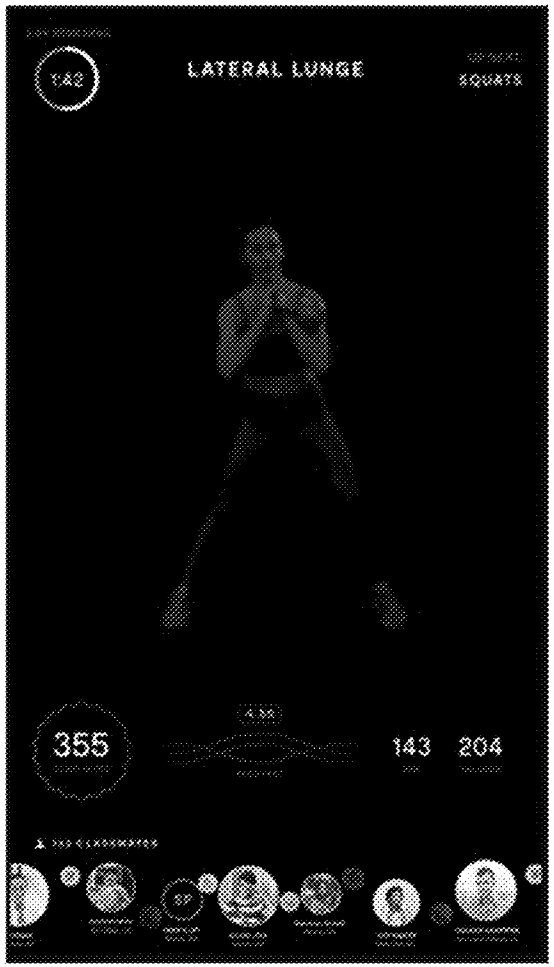
Figure 12G:
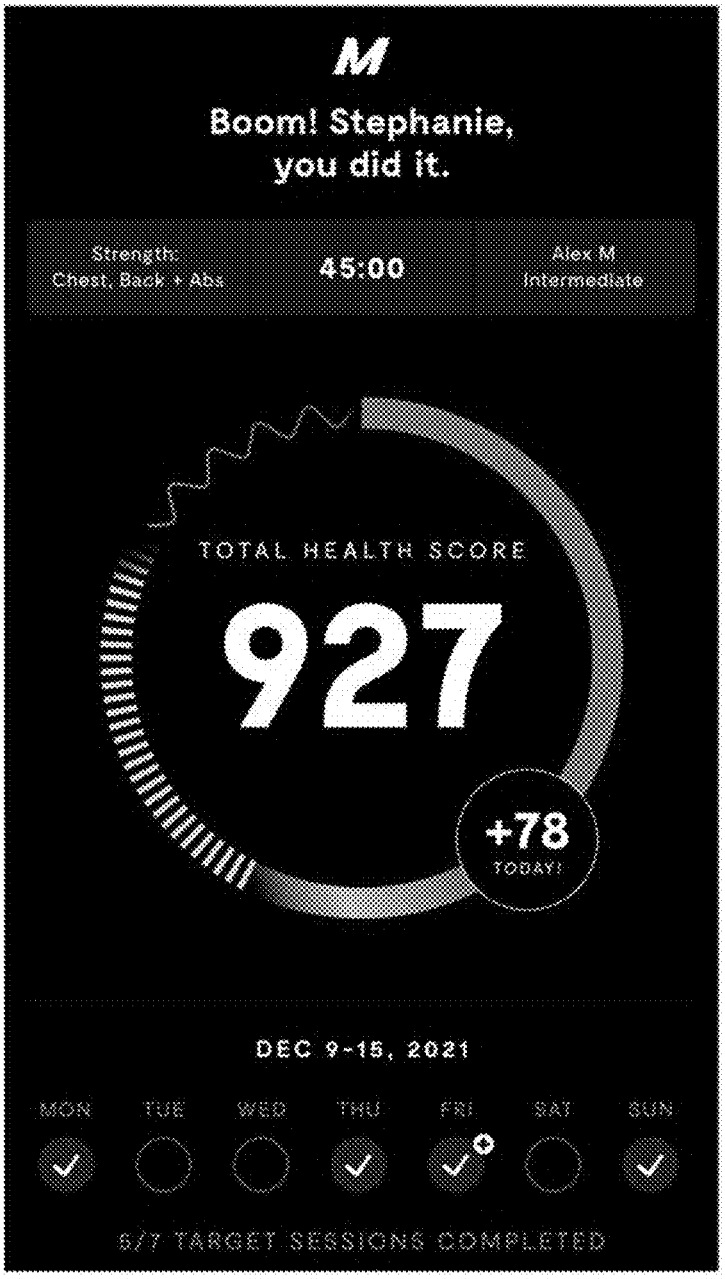
Figure 13A:
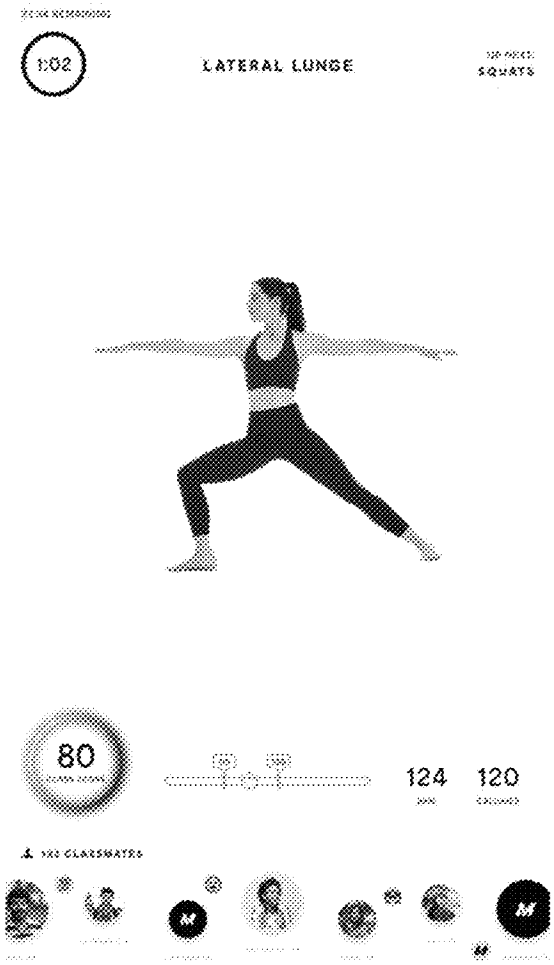
FIGS. 13A-13H are example GUI displays showing the generation and display of a universal health score, in accordance with some embodiments.
Figure 13B:
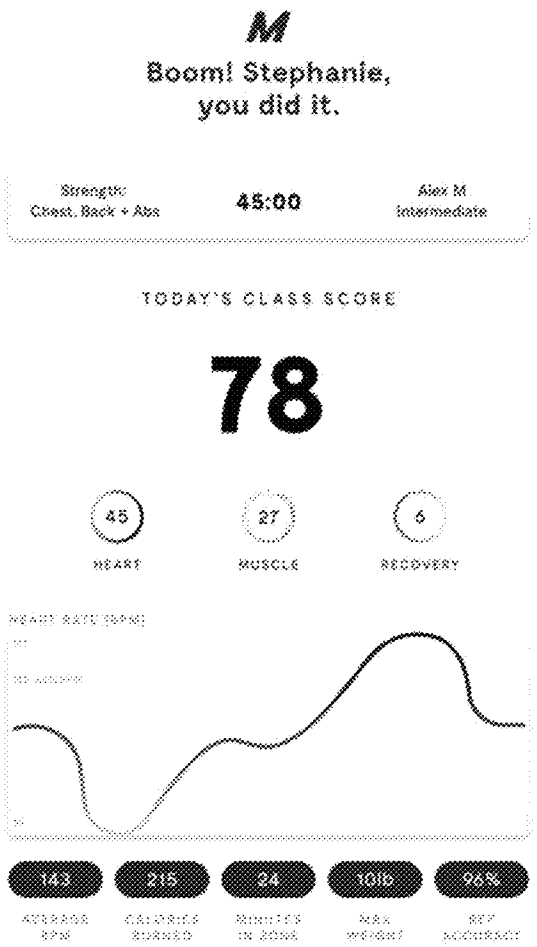
Figure 13D:
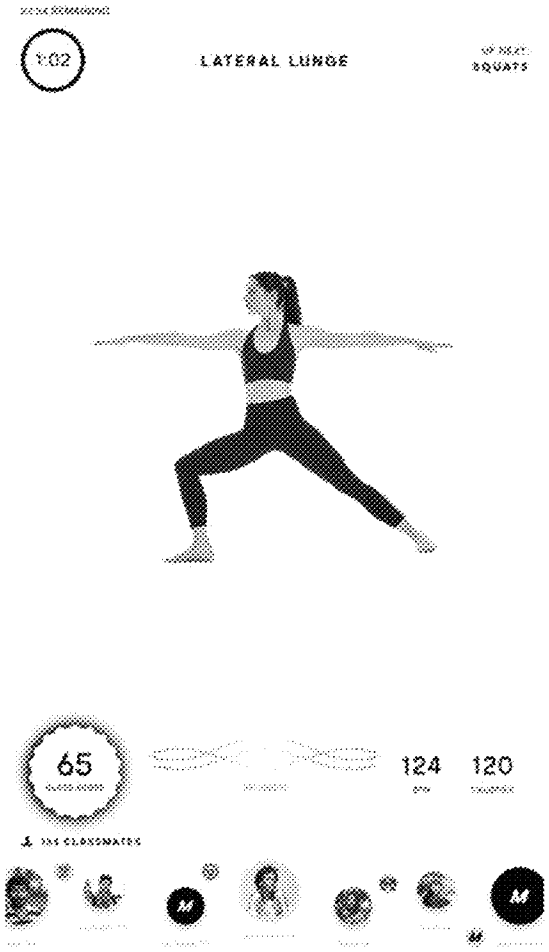
Figure 13C:
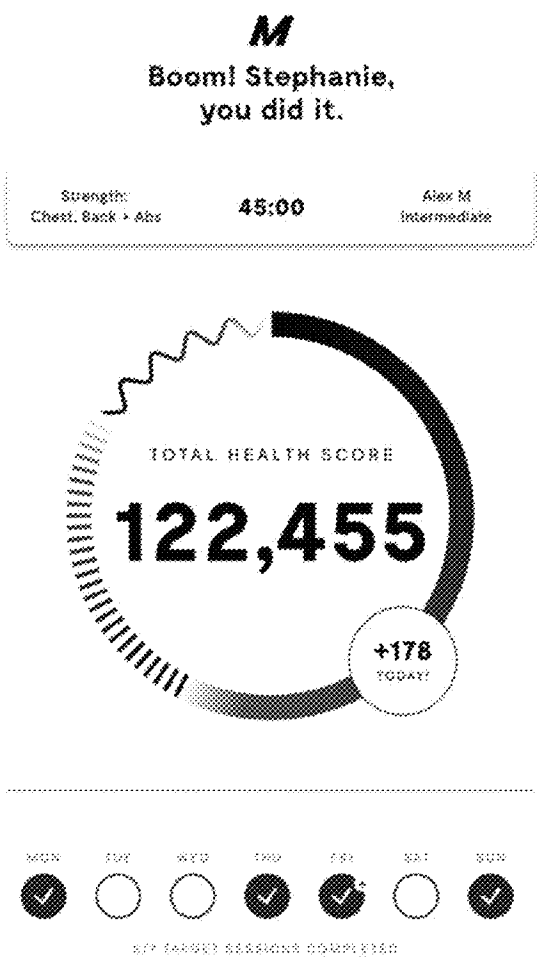
Figure 13F:
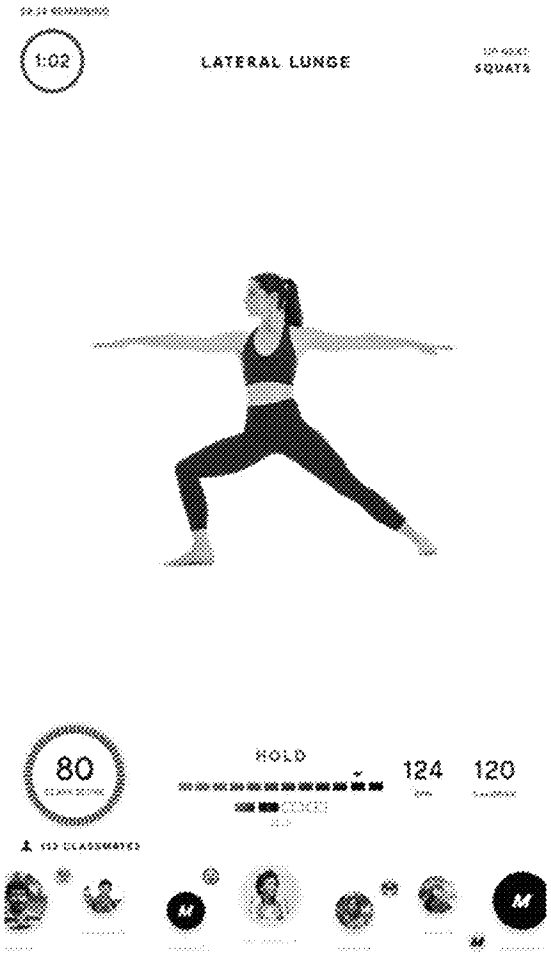
Figure 13E:
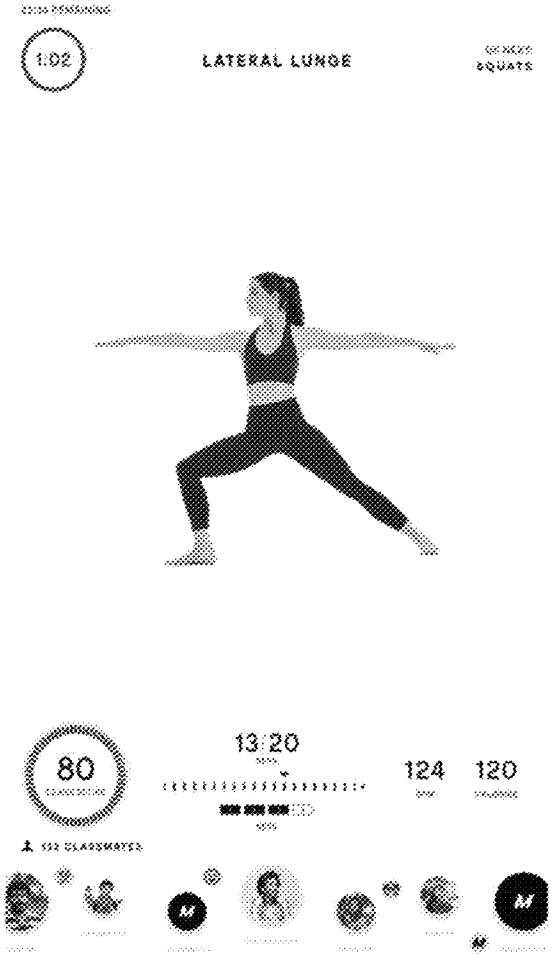
Figure 13H:
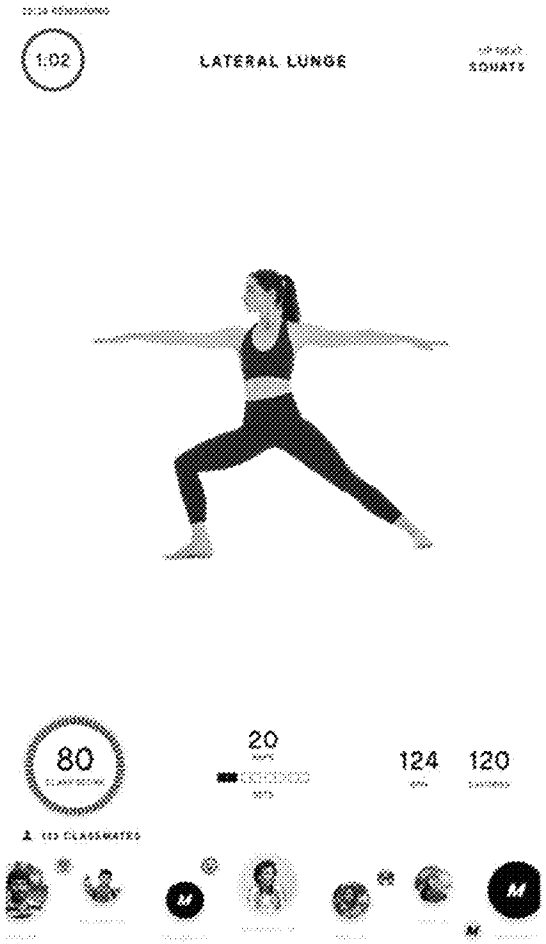
Figure 13G:
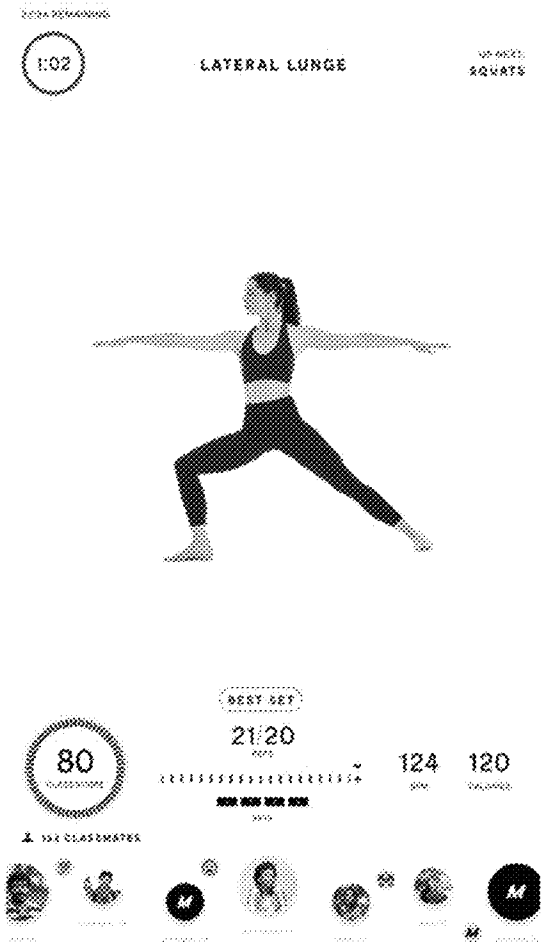

FIGS. 12A-12G are example graphical user interface (GUI) displays showing the generation and display of a universal health score, in accordance with some embodiments. More specifically, FIG. 12A shows an in-workout view of heart rate (see 1202—graphical depiction of heart rate and numerical heart rate are shown) and heart score 1204. FIG. 12B shows an in-workout view of repetition counting 1206. FIG. 12C shows an in-workout view of a muscle exercise with no repetitions ("HOLD"). FIG. 12D shows an in-workout view of a muscle exercise with no repetitions ("KEEP MOVING"). FIG. 12E shows an in-workout view of a recovery exercise. FIG. 12F shows a post-workout view of composite exercise scores (heart, muscle, and recovery scores) and a total class score ("78"). FIG. 12G shows a post-workout view of a total class score added to a total health score. As discussed above, and as shown in FIG. 12G, a total health score can include three different components—heart (represented by the bar 1208 in FIG. 12G), muscle (represented by the short radial lines 1210 in FIG. 12G), and recovery (represented by the wavy line 1212 in FIG. 12G)—and each can represent scores based on a current workout or scores based on a compilation/aggregation of all exercises performed by a given user (e.g., within a predefined time duration, or overall historical). FIGS. 13A-13H are additional example GUI displays showing the generation and display of a universal health score, in accordance with some embodiments.

As used herein, the terms "substantially," "approximately," and "about," when referencing a numeric value, generally refer to plus or minus 10% of the value stated (e.g., "about 100" would include 90 to 110). The term "substantially," when referencing a non-numeric value, generally means "to a great or significant extent." For example, "substantially curved" can refer to a shape that approximates a curve but may not be perfectly symmetrical or curvilinear.

In some embodiments, an apparatus includes an elongate flexible housing and a plurality of elongate weights positioned within the elongate flexible housing. Each elongate weight from the plurality of elongate weights includes a plurality of pellets embedded within a cured gel. The elongate flexible housing is configured to be positioned about a portion of a body of a user during use.

In some implementations, the apparatus also includes a fastener (e.g., a curved metal hook or an angled metal hook) configured to removably secure the elongate flexible housing against the portion of the body of the user when the apparatus is positioned about the portion of the body of the user during use. The apparatus can also include a plurality of recesses defined within the elongate flexible housing, each recess from the plurality of recesses configured to receive the fastener therethrough.

In some implementations, the apparatus also includes a plurality of fasteners (e.g., a plurality of curved metal hooks or angled metal hooks) configured to removably secure the elongate flexible housing against the portion of the body of the user when the apparatus is positioned about the portion of the body of the user during use. The apparatus can also include a recess defined within the elongate flexible housing, fastener from the plurality of fasteners configured to mechanically couple to the recess.

In some implementations, the apparatus includes a fastener including one or more of any of: a hook, a snap, a hook-and-loop closure, a button, a zipper, a lace-up closure, a magnetic closure, or a clamp.

In some implementations, the plurality of elongate weights is positioned within a first portion of the elongate flexible housing, and the apparatus also includes an electronics assembly positioned within a second portion of the elongate flexible housing. The second portion of the elongate flexible housing can be adjacent to and mutually exclusive from the first portion of the elongate flexible housing. Optionally, the second portion of the elongate flexible housing includes a numeral-shaped portion defined therein, and the electronics assembly includes at least one light-emitting diode (LED) that, when illuminated and during use, emits light that is visible to the user via the numeral-shaped portion.

The at least one LED can be configured to emit light at multiple different wavelengths, each wavelength from the multiple different wavelengths being selectable via a processor of the electronics assembly and/or associated with a status from a plurality of statuses. The plurality of statuses can include, by way of example only, one or more of: apparatus in use, apparatus not in use, apparatus in position (e.g., secured about a portion of a user), apparatus in motion, battery low, battery charged, battery fully charged, successful wireless connection with smart mirror or other remote compute device, failed attempt to wirelessly connect with smart mirror or other remote compute device, repetition number within a set of repetitions, completion of a set of repetitions, weight too high, weight too low, high score achieved, a predefined time period has elapsed, a friend has joined a workout session via his/her smart mirror or mobile software application ("app"), social media event (e.g., new friend, new message, etc.), etc. The electronics assembly can be configured to wirelessly connect to a smart mirror.

Additionally, in some implementations, the apparatus (i.e., the smart flexible weight) can include one or more biometric sensors (e.g., pulse/heart rate monitors, temperature sensors, blood oxygen sensors, etc.) configured to detect biometric data, and the at least one LED can be configured to emit patterns, intensities, and/or colors of light to indicate transmission of the biometric data to the smart mirror or other remote compute device and/or indicate that the biometric data is within a predefined/desired range or out of the predefined/desired range.

Additionally, in some implementations, the apparatus (i.e., the smart flexible weight) can receive data from the smart mirror or other remote compute device (e.g., a mobile compute device such as a smartphone). The at least one LED can be configured to emit patterns, intensities, and/or colors of light to indicate (e.g., using a first color and/or pattern) that data is being received from the smart mirror or other remote compute device and/or to indicate (e.g., using a second color and/or pattern different from the first color and/or pattern) that data is being sent from the apparatus to the smart mirror or other remote compute device.

Additionally, in some implementations, the apparatus (i.e., the smart flexible weight) can include a rechargeable battery that is at least one of wirelessly rechargeable or rechargeable by cable connection to an external power source. In such implementations, the at least one LED can be configured to emit patterns, intensities, and/or colors of light to indicate a charging status (e.g., currently charging, not charging), a charging progress (e.g., low intensity green light at 10% charged, medium intensity green light at 50% charged, and bright intensity green light at 100% charged).

Additionally, in some implementations, the apparatus (i.e., the smart flexible weight) is a first apparatus that can be configured to connect and communicate with one or more additional apparatuses (which may include other smart flexible weights, smart dumbbells, and/or other smart appliances). For example, in some such implementations, an exercise routine specifies that two smart flexible weights are to be used, so the user dons/wears two smart flexible weights. During the exercise routine (e.g., displayed via a smart mirror that is connected wirelessly with at least one of the two smart flexible weights), the at least one LED of one of the smart flexible weights may flash during a time period when that smart flexible weight is to be used, and cease flashing when the time period has elapsed. The at least one LED of the other of the smart flexible weights may then begin flashing (corresponding to a second time period during which that smart flexible weight is to be used). As another example, even if an exercise routine specifies that only one smart flexible weight is to be used, the at least one LED of one "ideal" smart flexible weight from a set of smart flexible weights may begin flashing to signify to the user that he/she should use that particular weight. The identification of the ideal smart flexible weight can be performed, for example, by the smart mirror (e.g., calculated based on a description of the exercise routine, selected based on a specification input made by an instructor, selected based on a selection input made by the user, calculated/selected based on historical weight data of the user, calculated/selected based on historical preferences of the user, calculated/selected based on historical performance of the user, calculated/selected based on historical scoring of the user, selected based on detected charge levels of one or more smart flexible weights from the set of smart flexible weights, or any of the foregoing in combination). Alternatively, the identification of the ideal smart flexible weight can be performed by a mobile app running on a compute device (e.g., the smartphone of the user, a remote compute device, etc.), where the mobile app is in communication with at least one of the smart mirror or the set of smart flexible weights.

In some implementations, the plurality of pellets includes at least one of steel pellets, lead pellets, or stainless steel pellets.

In some implementations, each elongate weight from the plurality of elongate weights has a substantially cylindrical shape.

In some embodiments, an apparatus includes an elongate flexible housing, an electronics assembly, a plurality of elongate weights, and a first fastener portion affixed to the first portion of the elongate flexible housing. The electronics assembly is positioned within a first portion of the elongate flexible housing, and includes at least one light-emitting diode (LED). The plurality of elongate weights is positioned within a second portion of the elongate flexible housing, and the second portion of the elongate flexible housing is different from and linearly spaced from the first portion of the elongate flexible housing. Each elongate weight from the plurality of elongate flexible weights includes a plurality of pellets. The first fastener portion is configured to mechanically couple with a second fastener portion of the second portion of the elongate flexible housing.

In some implementations, the first fastener portion is a hook and the second fastener portion is a slot from a plurality of slots defined within the second portion of the elongate flexible housing.

In some implementations, the first fastener portion is a recess and the second fastener portion is a hook from a plurality of hooks mechanically coupled to the second portion of the elongate flexible housing.

In some implementations, each elongate weight from the plurality of elongate flexible weights further includes an elastomer.

In some implementations, each elongate weight from the plurality of elongate flexible weights further includes one of rubber or silicone.

In some implementations, the plurality of pellets includes at least one of steel pellets, lead pellets, or stainless steel pellets.

In some implementations, the electronics assembly includes a communications interface configured to transmit a wireless signal to a smart mirror to indicate that the apparatus is in use. The electronics assembly can also include at least one sensor configured to detect that the apparatus is in use. The at least one sensor can include at least one of a vibration sensor, a motion sensor, an accelerometer, or a temperature sensor.

In some implementations, each elongate weight from the plurality of elongate weights includes a flexible plastic casing within which the associated plurality of pellets is positioned.

In some implementations, at least a portion of the first fastener portion is one of curved or angled.

In some implementations, the first fastener portion includes a protrusion configured to retain the first fastener portion within a slot from a plurality of slots defined within the second portion of the elongate flexible housing when the first fastener portion is mechanically coupled with the slot from the plurality of slots.

In some embodiments, an apparatus includes an elongate flexible housing, a plurality of elongate weights, and a first fastener portion affixed to the first portion of the elongate flexible housing, but does not include an electronics assembly. In other embodiments, an apparatus includes an elongate flexible housing, a plurality of elongate weights, a first fastener portion affixed to the first portion of the elongate flexible housing, and an electronics assembly but does not include any LEDs. In still other embodiments, an apparatus includes an elongate flexible housing, a plurality of elongate weights, and at least one LED, but does not include a communications interface.

In some embodiments, a kit includes a first exercise apparatus and a second exercise apparatus. The first exercise apparatus includes a first elongate flexible housing and a first plurality of elongate weights. The first plurality of elongate weights is positioned within the first elongate flexible housing, and each elongate weight from the first plurality of elongate weights includes a first plurality of pellets embedded within a first cured gel. The first elongate flexible housing is configured to be positioned about a portion of a body of a user during use. The second exercise apparatus includes a second elongate flexible housing and a second plurality of elongate weights. The second plurality of elongate weights is positioned within the second elongate flexible housing, and each elongate weight from the second plurality of elongate weights includes a second plurality of pellets embedded within a second cured gel. The second elongate flexible housing is configured to be positioned about a second portion of the body of the user during use.

In some implementations, a number of pellets in each of the first pluralities of pellets is different from a number of pellets in each of the second pluralities of pellets, and a weight of the first exercise apparatus is different from a weight of the second exercise apparatus.

In some implementations, a density of pellets within the first cured gel (also referred to herein as a "packing density") in each of the first pluralities of pellets is different from a density of pellets within the second cured gel in each of the second pluralities of pellets, and a weight of the first exercise apparatus is different from a weight of the second exercise apparatus. For example, a density of pellets within the first cured gel in each of the first pluralities of pellets may be about 74% while a density of pellets within the second cured gel in each of the second pluralities of pellets may be about 64%. As another example, a density of pellets within the first cured gel in each of the first pluralities of pellets may be between about 70% and about 75% while a density of pellets within the second cured gel in each of the second pluralities of pellets may be between about 60% and about 65%. Higher packing densities (e.g., closer to 75%) may correlate to higher weights, whereas lower packing densities may correlate to lower weights.

In some implementations, a number of pellets in each of the first pluralities of pellets is greater than a number of pellets in each of the second pluralities of pellets, and a weight of the first exercise apparatus is greater than a weight of the second exercise apparatus.

In some implementations, a number of pellets in each of the first pluralities of pellets is greater than a number of pellets in each of the second pluralities of pellets, and a weight of the first exercise apparatus is less than a weight of the second exercise apparatus.

In some implementations, a volume of the first cured gel in each elongate weight from the first plurality of elongate weights is different from a volume of the second cured gel in each elongate weight from the second plurality of elongate weights, and a weight of the first exercise apparatus is different from a weight of the second exercise apparatus.

In some implementations, a volume of the first cured gel in each elongate weight from the first plurality of elongate weights is greater than a volume of the second cured gel in each elongate weight from the second plurality of elongate weights, and a weight of the first exercise apparatus is lower than a weight of the second exercise apparatus.

All combinations of the foregoing concepts and additional concepts discussed herewithin (provided such concepts are not mutually inconsistent) are contemplated as being part of the subject matter disclosed herein. The terminology explicitly employed herein that also may appear in any disclosure incorporated by reference should be accorded a meaning most consistent with the particular concepts disclosed herein.

The drawings are primarily for illustrative purposes, and are not intended to limit the scope of the subject matter described herein. The drawings are not necessarily to scale; in some instances, various aspects of the subject matter disclosed herein may be shown exaggerated or enlarged in the drawings to facilitate an understanding of different features. In the drawings, like reference characters generally refer to like features (e.g., functionally similar and/or structurally similar elements).

The entirety of this application (including the Cover Page, Title, Headings, Background, Summary, Brief Description of the Drawings, Detailed Description, Embodiments, Abstract, Figures, Appendices, and otherwise) shows, by way of illustration, various embodiments in which the embodiments may be practiced. The advantages and features of the application are of a representative sample of embodiments only, and are not exhaustive and/or exclusive. Rather, they are presented to assist in understanding and teach the embodiments, and are not representative of all embodiments. As such, certain aspects of the disclosure have not been discussed herein. That alternate embodiments may not have been presented for a specific portion of the innovations or that further undescribed alternate embodiments may be available for a portion is not to be considered to exclude such alternate embodiments from the scope of the disclosure. It will be appreciated that many of those undescribed embodiments incorporate the same principles of the innovations and others are equivalent. Thus, it is to be understood that other embodiments may be utilized and functional, logical, operational, organizational, structural and/or topological modifications may be made without departing from the scope and/or spirit of the disclosure. As such, all examples and/or embodiments are deemed to be non-limiting throughout this disclosure.

Also, no inference should be drawn regarding those embodiments discussed herein relative to those not discussed herein other than it is as such for purposes of reducing space and repetition. For instance, it is to be understood that the logical and/or topological structure of any combination of any program components (a component collection), other components and/or any present feature sets as described in the figures and/or throughout are not limited to a fixed operating order and/or arrangement, but rather, any disclosed order is exemplary and all equivalents, regardless of order, are contemplated by the disclosure.

Various concepts may be embodied as one or more methods, of which at least one example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments. Put differently, it is to be understood that such features may not necessarily be limited to a particular order of execution, but rather, any number of threads, processes, services, servers, and/or the like that may execute serially, asynchronously, concurrently, in parallel, simultaneously, synchronously, and/or the like in a manner consistent with the disclosure. As such, some of these features may be mutually contradictory, in that they cannot be simultaneously present in a single embodiment. Similarly, some features are applicable to one aspect of the innovations, and inapplicable to others.

The term "automatically" is used herein to modify actions that occur without direct input or prompting by an external source such as a user. Automatically occurring actions can occur periodically, sporadically, in response to a detected event (e.g., a user logging in), or according to a predetermined schedule.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

Some embodiments and/or methods described herein can be performed by software (executed on hardware), hardware, or a combination thereof. Hardware modules may include, for example, a processor, a field programmable gate array (FPGA), and/or an application specific integrated circuit (ASIC). Software modules (executed on hardware) can include instructions stored in a memory that is operably coupled to a processor, and can be expressed in a variety of software languages (e.g., computer code), including C, C++, Java™, Ruby, Visual Basic™, and/or other object-oriented, procedural, or other programming language and development tools. Examples of computer code include, but are not limited to, micro-code or micro-instructions, machine instructions, such as produced by a compiler, code used to produce a web service, and files containing higher-level instructions that are executed by a computer using an interpreter. For example, embodiments may be implemented using imperative programming languages (e.g., C, Fortran, etc.), functional programming languages (Haskell, Erlang, etc.), logical programming languages (e.g., Prolog), object-oriented programming languages (e.g., Java, C++, etc.) or other suitable programming languages and/or development tools. Additional examples of computer code include, but are not limited to, control signals, encrypted code, and compressed code.

The term "processor" should be interpreted broadly to encompass a general purpose processor, a central processing unit (CPU), a microprocessor, a digital signal processor (DSP), a controller, a microcontroller, a state machine and so forth. Under some circumstances, a "processor" may refer to an application specific integrated circuit (ASIC), a programmable logic device (PLD), a field programmable gate array (FPGA), etc. The term "processor" may refer to a combination of processing devices, e.g., a combination of a DSP and a microprocessor, a plurality of microprocessors, one or more microprocessors in conjunction with a DSP core or any other such configuration.

The term "memory" should be interpreted broadly to encompass any electronic component capable of storing electronic information. The term memory may refer to various types of processor-readable media such as random access memory (RAM), read-only memory (ROM), non-volatile random access memory (NVRAM), programmable read-only memory (PROM), erasable programmable read only memory (EPROM), electrically erasable PROM (EEPROM), flash memory, magnetic or optical data storage, registers, etc. Memory is said to be in electronic communication with a processor if the processor can read information from and/or write information to the memory. Memory that is integral to a processor is in electronic communication with the processor.

The terms "instructions" and "code" should be interpreted broadly to include any type of computer-readable statement (s). For example, the terms "instructions" and "code" may refer to one or more programs, routines, sub-routines, functions, procedures, etc. "Instructions" and "code" may comprise a single computer-readable statement or many computer-readable statements.

Some embodiments described herein relate to a computer storage product with a non-transitory computer-readable medium (also can be referred to as a non-transitory processor-readable medium) having instructions or computer code thereon for performing various computer-implemented operations. The computer-readable medium (or processor-readable medium) is non-transitory in the sense that it does not include transitory propagating signals per se (e.g., a propagating electromagnetic wave carrying information on a transmission medium such as space or a cable). The media and computer code (also can be referred to as code) may be those designed and constructed for the specific purpose or purposes. Examples of non-transitory computer-readable media include, but are not limited to, magnetic storage media such as hard disks, floppy disks, and magnetic tape; optical storage media such as Compact Disc/Digital Video Discs (CD/DVDs), Compact Disc-Read Only Memories (CD-ROMs), and holographic devices; magneto-optical storage media such as optical disks; carrier wave signal processing modules; and hardware devices that are specially configured to store and execute program code, such as Application-Specific Integrated Circuits (ASICs), Programmable Logic Devices (PLDs), Read-Only Memory (ROM) and Random-Access Memory (RAM) devices. Other embodiments described herein relate to a computer program product, which can include, for example, the instructions and/or computer code discussed herein.

Some embodiments and/or methods described herein can be performed by software (executed on hardware), hardware, or a combination thereof. Hardware modules may include, for example, a general-purpose processor, a field programmable gate array (FPGA), and/or an application specific integrated circuit (ASIC). Software modules (executed on hardware) can be expressed in a variety of software languages (e.g., computer code), including C, C++, Java™, Ruby, Visual Basic™, and/or other object-oriented, procedural, or other programming language and development tools. Examples of computer code include, but are not limited to, micro-code or micro-instructions, machine instructions, such as produced by a compiler, code used to produce a web service, and files containing higher-level instructions that are executed by a computer using an interpreter. For example, embodiments may be implemented using imperative programming languages (e.g., C, Fortran, etc.), functional programming languages (Haskell, Erlang, etc.), logical programming languages (e.g., Prolog), object-oriented programming languages (e.g., Java, C++, etc.) or other suitable programming languages and/or development tools. Additional examples of computer code include, but are not limited to, control signals, encrypted code, and compressed code.

Various concepts may be embodied as one or more methods, of which at least one example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments. Put differently, it is to be understood that such features may not necessarily be limited to a particular order of execution, but rather, any number of threads, processes, services, servers, and/or the like that may execute serially, asynchronously, concurrently, in parallel, simultaneously, synchronously, and/or the like in a manner consistent with the disclosure. As such, some of these features may be mutually contradictory, in that they cannot be simultaneously present in a single embodiment. Similarly, some features are applicable to one aspect of the innovations, and inapplicable to others.

In addition, the disclosure may include other innovations not presently described. Applicant reserves all rights in such innovations, including the right to embodiment such innovations, file additional applications, continuations, continuations-in-part, divisionals, and/or the like thereof. As such, it should be understood that advantages, embodiments, examples, functional, features, logical, operational, organizational, structural, topological, and/or other aspects of the disclosure are not to be considered limitations on the disclosure as defined by the embodiments or limitations on equivalents to the embodiments. Depending on the particular desires and/or characteristics of an individual and/or enterprise user, database configuration and/or relational model, data type, data transmission and/or network framework, syntax structure, and/or the like, various embodiments of the technology disclosed herein may be implemented in a manner that enables a great deal of flexibility and customization as described herein.

All definitions, as defined and used herein, should be understood to control over dictionary definitions, definitions in documents incorporated by reference, and/or ordinary meanings of the defined terms.

As used herein, in particular embodiments, the terms "about" or "approximately" when preceding a numerical value indicates the value plus or minus a range of 10%. Where a range of values is provided, it is understood that each intervening value, to the tenth of the unit of the lower limit unless the context clearly dictates otherwise, between the upper and lower limit of that range and any other stated or intervening value in that stated range is encompassed within the disclosure. That the upper and lower limits of these smaller ranges can independently be included in the smaller ranges is also encompassed within the disclosure, subject to any specifically excluded limit in the stated range. Where the stated range includes one or both of the limits, ranges excluding either or both of those included limits are also included in the disclosure.

The indefinite articles "a" and "an," as used herein in the specification and in the embodiments, unless clearly indicated to the contrary, should be understood to mean "at least one."

The phrase "and/or," as used herein in the specification and in the embodiments, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the embodiments, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the embodiments, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the embodiments, shall have its ordinary meaning as used in the field of patent law.

As used herein in the specification and in the embodiments, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the embodiments, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. An apparatus, comprising:

an elongate flexible housing; and a plurality of elongate weights positioned within the elongate flexible housing, each elongate weight from the plurality of elongate weights including a plurality of pellets embedded within a cured gel, each elongate weight from the plurality of elongate weights being fully encompassed by the elongate flexible housing, the elongate flexible housing configured to be positioned about a portion of a body of a user during use.

2. The apparatus of claim 1, further comprising a fastener to removably secure the elongate flexible housing against the portion of the body of the user when the apparatus is positioned about the portion of the body of the user during use.

3. The apparatus of claim 2, further comprising a plurality of recesses defined within the elongate flexible housing, each recess from the plurality of recesses configured to receive the fastener therethrough.

4. The apparatus of claim 2, wherein the fastener is one of a curved metal hook or an angled metal hook.

5. The apparatus of claim 1, wherein the plurality of elongate weights is positioned within a first portion of the elongate flexible housing, the apparatus further comprising an electronics assembly positioned within a second portion of the elongate flexible housing, the second portion of the elongate flexible housing being adjacent to and mutually exclusive from the first portion of the elongate flexible housing.

6. The apparatus of claim 5, wherein the second portion of the elongate flexible housing includes a numeral-shaped portion defined therein, and the electronics assembly includes at least one light-emitting diode (LED) that, when illuminated and during use, emits light that is visible to the user via the numeral-shaped portion.

7. The apparatus of claim 6, wherein the at least one LED is configured to emit light at multiple different wavelengths, each wavelength from the multiple different wavelengths being selectable via a processor of the electronics assembly and associated with a status from a plurality of statuses.

8. The apparatus of claim 5, wherein the electronics assembly is configured to wirelessly connect to a smart mirror.

9. The apparatus of claim 1, wherein the plurality of pellets includes at least one of steel pellets, lead pellets, or stainless steel pellets.

10. The apparatus of claim 1, wherein each elongate weight from the plurality of elongate weights has a substantially cylindrical shape.

11. An apparatus, comprising:

an elongate flexible housing;

an electronics assembly positioned within a first portion of the elongate flexible housing, the electronics assembly including at least one light-emitting diode (LED);

a plurality of elongate weights positioned within a second portion of the elongate flexible housing, the second portion of the elongate flexible housing different from and linearly spaced from the first portion of the elongate flexible housing, each elongate weight from the plurality of elongate flexible weights including a plurality of pellets and fully encompassed by the elongate flexible housing; and a first fastener portion affixed to the first portion of the elongate flexible housing, the first fastener portion configured to mechanically couple with a second fastener portion of the second portion of the elongate flexible housing.

12. The apparatus of claim 11, wherein the first fastener portion is a hook and the second fastener portion is a slot from a plurality of slots defined within the second portion of the elongate flexible housing.

13. The apparatus of claim 11, wherein each elongate weight from the plurality of elongate flexible weights further includes one of rubber or silicone.

14. The apparatus of claim 11, wherein the plurality of pellets includes at least one of steel pellets, lead pellets, or stainless steel pellets.

15. The apparatus of claim 11, wherein the electronics assembly includes a communications interface configured to transmit a wireless signal to a smart mirror to indicate that the apparatus is in use.

16. The apparatus of claim 15, wherein the electronics assembly further includes at least one sensor configured to detect that the apparatus is in use.

17. The apparatus of claim 16, wherein the at least one sensor includes at least one of a vibration sensor, a motion sensor, an accelerometer, or a temperature sensor.

18. The apparatus of claim 11, wherein each elongate weight from the plurality of elongate weights includes a flexible plastic casing within which the associated plurality of pellets is positioned.

19. The apparatus of claim 11, wherein at least a portion of the first fastener portion is one of curved or angled.

20. The apparatus of claim 11, wherein the first fastener portion includes a protrusion configured to retain the first fastener portion within a slot from a plurality of slots defined within the second portion of the elongate flexible housing when the first fastener portion is mechanically coupled with the slot from the plurality of slots.

21. A method of producing an exercise apparatus, the method comprising:

producing a plurality of elongate weights, by:

combining a plurality of pellets with a gel to produce a mixture, introducing the mixture into a sleeve to produce a filled sleeve, at least one of constricting or twisting the filled sleeve in multiple locations, to produce a plurality of terminations along the filled sleeve, and cleaving the filled sleeve at each termination from the plurality of terminations, to produce the plurality of elongate weights; and assembling the exercise apparatus by placing each elongate weight from the plurality of elongate weights into an elongate flexible housing.

22. The method of claim 21, wherein the gel includes an elastomer.

23. The method of claim 21, wherein the plurality of pellets includes at least one of steel pellets, lead pellets, or stainless steel pellets.

24. A kit, comprising:

a first exercise apparatus, including:

a first elongate flexible housing, and a first plurality of elongate weights positioned within the first elongate flexible housing, each elongate weight from the first plurality of elongate weights including a first plurality of pellets embedded within a first cured gel and fully encompassed by the elongate flexible housing, the first elongate flexible housing configured to be positioned about a portion of a body of a user during use; and a second exercise apparatus, including:

a second elongate flexible housing, and a second plurality of elongate weights positioned within the second elongate flexible housing, each elongate weight from the second plurality of elongate weights including a second plurality of pellets embedded within a second cured gel, the second elongate flexible housing configured to be positioned about a second portion of the body of the user during use.

25. The kit of claim 24, wherein a number of pellets in each of the first pluralities of pellets is different from a number of pellets in each of the second pluralities of pellets, and a weight of the first exercise apparatus is different from a weight of the second exercise apparatus.

26. The kit of claim 24, wherein a number of pellets in each of the first pluralities of pellets is greater than a number of pellets in each of the second pluralities of pellets, and a weight of the first exercise apparatus is greater than a weight of the second exercise apparatus.

27. The kit of claim 24, wherein a number of pellets in each of the first pluralities of pellets is greater than a number of pellets in each of the second pluralities of pellets, and a weight of the first exercise apparatus is less than a weight of the second exercise apparatus.

28. The kit of claim 24, wherein a volume of the first cured gel in each elongate weight from the first plurality of elongate weights is different from a volume of the second cured gel in each elongate weight from the second plurality of elongate weights, and a weight of the first exercise apparatus is different from a weight of the second exercise apparatus.

29. The kit of claim 24, wherein a volume of the first cured gel in each elongate weight from the first plurality of elongate weights is greater than a volume of the second cured gel in each elongate weight from the second plurality of elongate weights, and a weight of the first exercise apparatus is lower than a weight of the second exercise apparatus.

30. The apparatus of claim 11, wherein each elongate weight from the plurality of elongate flexible weights further includes an elastomer.

* * * * *